US005213958A

United States Patent [19]

Motoki et al.

[11] Patent Number: 5,213,958

[45] Date of Patent: May 25, 1993

[54] SILVER HALIDE COLOR PHOTOGRAPHIC MATERIAL CONTAINING A PHOTOGRAPHIC YELLOW DYE FORMING COUPLER

[75] Inventors: Masuji Motoki; Seiji Ichijima; Naoki Saito; Takayoshi Kamio; Keiji Mihayashi, all of Kanagawa, Japan

[73] Assignee: Fuji Photo Film Co., Ltd., Kanagawa, Japan

[21] Appl. No.: 779,374

[22] Filed: Oct. 18, 1991

[30] Foreign Application Priority Data

Oct. 24, 1990 [JP] Japan ..... 2-286341
Aug. 15, 1991 [JP] Japan ..... 3-228500

[51] Int. Cl.[5] ..... G03C 7/36
[52] U.S. Cl. ..... 430/557; 430/558
[58] Field of Search ..... 430/556, 557, 558

[56] References Cited

U.S. PATENT DOCUMENTS

| | | | |
|---|---|---|---|
| 4,095,984 | 6/1978 | Sueyoshi et al. | 430/544 |
| 4,149,886 | 3/1979 | Tanaka et al. | 430/557 |
| 4,477,886 | 10/1984 | Au | 365/222 |
| 4,579,816 | 4/1986 | Ohlschlager et al. | 430/557 |
| 5,066,576 | 11/1991 | Ichijima et al. | 430/558 |

FOREIGN PATENT DOCUMENTS

| | | |
|---|---|---|
| 0346899 | 12/1989 | European Pat. Off. . |
| 1558452 | 12/1969 | France . |
| 1204680 | 9/1970 | United Kingdom . |

*Primary Examiner*—Lee C. Wright
*Attorney, Agent, or Firm*—Birch, Stewart, Kolasch & Birch

[57] ABSTRACT

A silver halide color photographic photosensitive material comprising a yellow image forming photographic coupler, which is capable of forming images having excellent color reproduction and image fastness, and which has a high reactivity with an oxidized form of a developing agent. The aforementioned object has been realized by means of a silver halide color photographic photosensitive material containing a coupler represented by general formula (I):

General Formula (I)

wherein X represents an organic residual group which is required, together with the nitrogen atom, to form a nitrogen containing heterocyclic ring, Y represents an aromatic group or a heterocyclic group, and Z represents a group which is eliminated when the coupler represented by said general formula reacts with the oxidized form of a developing agent.

13 Claims, No Drawings

SILVER HALIDE COLOR PHOTOGRAPHIC MATERIAL CONTAINING A PHOTOGRAPHIC YELLOW DYE FORMING COUPLER

FIELD OF THE INVENTION

The present invention relates to novel yellow image forming photographic couplers. More precisely, the present invention relates to color photographic photosensitive materials, which are distinguished by containing photographic couplers having the ability to form images with excellent color reproduction and image fastness and which have a high reactivity with an oxidized form of a developing agent.

BACKGROUND OF THE INVENTION

In a color photographic photosensitive material, the image is formed by a reaction between couplers and an oxidized primary aromatic amine developing agent during color development, after exposing said material. Color reproduction with the subtractive color method is used in this system and blue, green and red are reproduced by means of yellow, magenta and cyan colored images which have a complementary color relationship with these colors.

Acylacetanilide type couplers or malondianilide type couplers have long been known as yellow couplers.

The couplers disclosed, for example, in U.S. Pat. Nos. 4,149,886, 4,095,984 and 4,477,563 or British Patent 1,204,680, are for example, known as malondianilide type couplers. However, these couplers have problems with low image fastness, and particularly low damp and heat fastness. Furthermore, the spectral absorption characteristics of the azomethine dyes obtained from these couplers have an extended tail on the long wavelength side and this is undesirable from the viewpoint of color reproduction.

SUMMARY OF THE INVENTION

The object of the present invention is to overcome the aforementioned problems. That is to say, the object of the present invention is to provide color photographic photosensitive materials which have good image fastness and good color reproduction properties.

The aforementioned object has been realized by means of a silver halide color photographic photosensitive material, wherein a coupler which can be represented by general formula (I) indicated below is included.

General Formula (I)

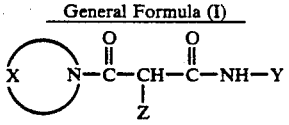

In this formula, X represents an organic residual group which is required, together with the nitrogen atom, to form a nitrogen containing heterocyclic ring, Y represents an aromatic group or a heterocyclic group, and Z represents a group which is eliminated when the coupler represented by said general formula reacts with the oxidized form of a developing agent.

DETAILED DESCRIPTION OF THE INVENTION

The couplers represented by general formula (I) are described in detail below.

The nitrogen containing heterocyclic group represented by X< and >N— may be a saturated or unsaturated, single ring or condensed ring, substituted or unsubstituted group which has at least 1 carbon atom, preferably from 1 to 20 carbon atoms, and most preferably from 2 to 12 carbon atoms. Nitrogen atoms, oxygen, sulfur or phosphorus atoms may also be included in these rings. The ring is at least a three membered ring, preferably a three to twelve membered ring, and most preferably a five or six membered ring.

Actual examples of heterocyclic groups which can be represented by X< and >N— include morpholino, 1-imida-zolidinyl, 1-pyrazolyl, 1-piperazino, 1-indolinyl, 1,2,3,4-tetrahydroquinoxalin-1-yl, 1-pyrrolinyl, pyrazolidin-1-yl, 2,3-dihydro-1-indazolyl, isoindolin-2-yl, 1-pyrrolyl, 2-pyrrazoline-1-yl, benzothiazin-4-yl, 4-thiazinyl, benzodiazin-1-yl, perhydro-1,1-dioxo-1,4-thiazine-4-yl, aziridin-1-yl, benzoxazin-4-yl, 2,3,4,5-tetrahydroquinolyl and phenoxazin-10-yl.

As a heterocyclic group formed of X< and >N— in the general formula (I) there may be preferably used a nitrogen-containing heterocyclic group containing at least one ethylenically unsaturated group. Examples of such a heterocyclic group include indolinyl, 2,3,4,5-tetrahydroquinolyl, isoindolino, and 4-oxopiperidino.

As a heterocyclic group formed of X< and >N— in the general formula (I) there may be preferably used a nitrogen-containing heterocyclic group containing at least two hetero atoms as ring constituent atoms. Examples of such a heterocyclic group include morpholino, piperadino, perhydro-1,1-dioxo-1,4-thiazine-4-yl, and benzomorpholino.

When Y in general formula (I) represents an aromatic group it is a substituted or unsubstituted aromatic group which has at least 6, and preferably from 6 to 10, carbon atoms.

When Y in general formula (I) represents a heterocyclic group it is a saturated or unsaturated, substituted or unsubstituted heterocyclic group which has at least 1, preferably from 1 to 10, and most preferably from 2 to 5, carbon atoms. Nitrogen, sulfur or oxygen atoms are preferred as hetero atoms. The ring is preferably a five or six membered ring, but it may be of some other size. It may be a single ring or a condensed ring. Actual examples, when Y represents a heterocyclic group, include 2-pyridyl, 4-pyrimidinyl, 5-pyrazolyl, 8-quinolyl, 2-furyl and 2-pyrrolyl.

In cases where the heterocyclic group represented by X< and >N— and the group represented by Y in general formula (I) each has substituent groups, these may be, for example, halogen atoms (for example, fluorine, chloride, bromide), alkoxycarbonyl groups (which have from 2 to 30, and preferably from 2 to 20, carbon atoms, for example methoxycarbonyl, dodecyloxycarbonyl, hexadecyloxycarbonyl), acylamino groups (which have from 2 to 30, and preferably from 2 to 20, carbon atoms, for example, acetamido, tetradecanamido, 2-(2,4-di-tert-amylphenoxy)-butanamido, benzamido), sulfonamido groups (which have from 1 to 30, and preferably from 1 to 20, carbon atoms, for example, methanesulfonamido, dodecanesulfonamido, hexadecanesulfonamido, benzenesulfonamido), carbamoyl groups (which have from 2 to 30, and preferably from 2 to 20, carbon atoms, for example N-butylcarbamoyl, N,N-diethylcarbamoyl), sulfamoyl groups (which have from 1 to 30, and preferably from 1 to 20 carbon atoms, for example, N-butylsulfamoyl, N-phenylsulfamoyl, N-dodecylsulfamoyl, N-hexadecylsulfamoyl, N-3-(2,4-di-tertamylphenoxy)butylsulfamoyl), alkoxy groups (which have from 1 to 30, and preferably from 1 to 24, carbon atoms, for example methoxy, dodecyloxy), N-acylsulfamoyl groups (which have from 2 to 30, and preferably from 2 to 20, carbon atoms, for example N-propanoylsulfamoyl, N-tetradecanoylsulfamoyl), sulfonyl groups (which have from 1 to 30, and preferably from 1 to 20, carbons atoms, for example methanesulfonyl, octanesulfonyl, dodecanesulfonyl), alkoxycarbonylamino groups (which have from 1 to 30, and preferably from 1 to 20, carbon atoms, for example methoxycarbonylamino, tetradecyloxycarbonylamino), cyano group, nitro group, carboxyl group, aryloxy groups (which have from 6 to 20, and preferably from 6 to 10, carbon atoms, for example, phenoxy, 4-chlorophenoxy), alkylthio groups (which have from 1 to 30, and preferably from 1 to 20, carbon atoms, for example, methylthio, dodecylthio), ureido groups (which have from 1 to 30, and preferably from 1 to 20, carbon atoms, for example, phenylureido), aryl groups (the same as those described when Y represents an aromatic group), heterocyclic groups (the same as those described when Y is a heterocyclic group), sulfo group, alkyl groups (linear chain, branched or cyclic, saturated or unsaturated, substituted or unsubstituted alkyl groups which have from 1 to 30, and preferably from 1 to 20 carbon atoms, for example, methyl, ethyl, iso-propyl, cyclopropyl, cyclopentyl, dodecyl, 2-hexyloctyl), acyl groups (which have from 1 to 30, and preferably from 2 to 20, carbon atoms, for example acetyl, benzoyl), arylthio groups (which have from 6 to 20, and preferably from 6 to 10, carbon atoms, for example phenylthio), or sulfamoylamino groups (which have from 0 to 30, and preferably from 0 to 20, carbon atoms, for example N-butylsulfamoylamino, N-dodecylsulfamoylamino).

Examples of the preferred substituent groups, when the heterocyclic group represented by X< and >N— has substituent groups, from among the aforementioned groups are halogen atoms, cyano groups, sulfonyl groups, acylamino groups, carbamoyl groups, alkyl groups, sulfonamido groups or nitro groups, but those cases in which there is no substituent group are also preferred.

Halogen atoms, alkoxycarbonyl groups, sulfamoyl groups, carbamoyl groups, sulfonyl groups, sulfonamido groups, alkyl groups, acylamino or aryloxy groups and alkoxy groups can be cited as examples of the substituent groups when the group represented by Y has substituent groups. All of the groups known conventionally as coupling leaving groups may be used for the group represented by Z in general formula (I). Nitrogen containing heterocyclic groups which are bonded to the coupling position with a nitrogen atom, aromatic oxy groups, aromatic thio groups, heterocyclic oxy groups, heterocyclic thio groups, acyloxy groups, carbamoyloxy groups, alkylthio groups or halogen atoms are preferred for Z. These leaving groups may be photographically useful groups or precursors thereof (for example, development inhibitors, development accelerators, de-silvering accelerators, fogging agents, dyes, film hardening agents, couplers, scavengers for the oxidized form of the developing agent, fluorescent dyes, developing agents or electron transfer agents), or non-photographically useful groups.

When Z represents a nitrogen containing heterocyclic group it is, more precisely, a single ring or condensed ring, substituted or unsubstituted heterocyclic group. Succinimido, maleimido, phthalimido, diglycolimido, pyrrolino, pyrazolyl, imidazolyl, 1,2,4-triazol-2-yl (or -4-yl), 1-tetrazolyl, indolyl, benzopyrazolyl, benzimidazolyl, benzotriazolyl, imidazolidin-2,4-dione-3-yl (or -1-yl), oxazolidin-2,4-dione-3-yl, thiazolidin-2,4-dione-3-yl, imidazolin-2-one-1-yl, oxazolin-2-one-3-yl, thiazolin-2-one-3-yl, benzoxazolin-2-one-3-yl, 1,2,4-triazolidin-3,5-dione-4-yl, 2-pyridon-1-yl, morpholin-3,5-dione-4-yl, 1,2,3-triazol-1-yl or 2-imidazolin-5-one can be cited as examples.

When these heterocyclic groups have substituent groups, these may be the substituent groups cited as the aforementioned substituent groups for the heterocyclic groups represented by X< and >N-.

When Z represents a nitrogen containing heterocyclic group it is preferably 1-pyrazolyl, imidazolyl, 1,2,3-triazol-1-yl, benzotriazolyl, 1,2,4-triazol-1-yl, oxazolidin-2,4-dione-3-yl, 1,2,4-triazolidin-3,5-dione-4-yl or imidazolidin-2,4-dione-3-yl. Cases in which the groups have substituent groups are also included.

When Z represents an aromatic oxy group it is preferably a substituted or unsubstituted phenoxy group. When the group has substituent groups, these are the aforementioned substituent group cited as substituent groups permitted for the groups represented by Y. Cases in which at least one substituent group, which is an electron withdrawing group is present as a substituent group on a phenoxy group, are preferred, and examples of such groups include sulfonyl groups, alkoxycarbonyl groups, sulfamoyl groups, halogen atoms, carbamoyl groups, acyl groups and nitro groups.

When Z represents an aromatic thio group it is preferably a substituted or unsubstituted phenylthio group. When this group has substituent groups they are, for example, the substituent groups cited as substituent groups which are permitted as substituent groups for the group represented by Y. Cases in which there are at least one alkyl, alkoxy, sulfonyl, alkoxycarbonyl or sulfamoyl group, halogen atom, or carbamoyl or nitro group present as a substituent group, are preferred when the phenylthio group has a substituent group.

When Z represents a heterocyclic oxy group the heterocyclic group moiety has the same significance as when Y represents a heterocyclic group.

When Z represents a heterocyclic thio group it is preferably a five or six membered unsaturated heterocyclic thio group. The tetrazolylthio, 1,3,4-thiadiazolylthio, 1,3,4-oxadiazolylthio, 1,3,4-triazolylthio, benzimidazolylthio, benzothiazolylthio and 2-pyridylthio groups can be cited as examples of such groups. These may have substituent groups, and those cited earlier as substituent groups when Y represents a heterocyclic group can be cited as such substituent groups. Aromatic groups, alkyl groups, alkylthio groups, acylamino groups, alkoxycarbonyl groups and aryloxycarbonyl groups are especially preferable from among these groups as substituent groups.

When Z is an acyloxy group it is, more precisely, an aromatic acyloxy group (which has from 7 to 11 carbon atoms, and is preferably a benzoyloxy group) or an aliphatic acyloxy group (which has from 2 to 20, and preferably from 2 to 10, carbon atoms), and it may have substituent groups. The substituent groups cited earlier as substituent groups when Y represents an aromatic group can be cited as actual examples of such substituent groups. Cases in which there are at least one halogen atom, nitro group, aryl group, alkyl group or alkoxy group as a substituent group are preferred.

When Z represents a carbamoyloxy group it is an aliphatic, aromatic, heterocyclic or unsubstituted carbamoyloxy group which has from 1 to 30, and preferably from 1 to 20, carbon atoms. For example, an N,N-diethylcarbamoyl, N-phenylcarbamoylmorpholinocarbonyloxy, 1-imidazolylcarbonyloxy or N,N-dimethylcarbamoyloxy group. Here, the detailed descriptions for alkyl groups, aromatic groups and heterocyclic groups are the same as those defined earlier in the description of substituents which Y may have.

When Z represents an alkythio group it is an alkythio group which has from 1 to 30, and preferably from 1 to 20, carbon atoms. The precise description of the alkyl groups is the same as that defined earlier in the description of substituents which Y may have.

Five or six membered nitrogen containing heterocyclic groups (bonded to the coupling position with a nitrogen atom), aromatic oxy groups, five or six membered heterocyclic oxy groups and five or six membered heterocyclic thio groups are preferred for the group represented by Z in general formula (I).

Aromatic groups are preferred for the group represented by Y in general formula (I). Phenyl groups which have at least one substituent group in the ortho-position are especially preferable. The groups described earlier as substituent groups when Y is an aromatic group, can be cited as such substituent groups.

When the group represented by Y in general formula (I) is a phenyl group which has at least one substituent group in the ortho-position, the substituent group in the ortho-position is most preferably a halogen atom, an alkoxy group, an aryloxy group, an alkyl group or an alkoxycarbonyl group.

Of the couplers represented by general formula (I), those which can be represented by general formula (II) or general formula (III) indicated below, are preferred.

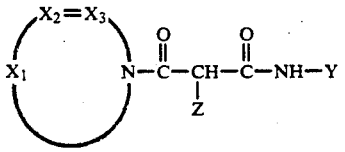

General Formula (II)

In this formula, Y and Z have the same significance as described in connection with general formula (I), $X_1$ represents an organic residual group which is required to form, together with $-X_2=X_3-N<$, a nitrogen containing heterocyclic group, and $X_2$ and $X_3$ each represent a methine group or a nitrogen atom.

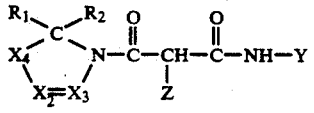

General Formula (III)

In this formula, $X_2$, $X_3$, Y and Z have the same significance as described earlier in connection with general formulae (I) and (II), $X_4$ represents a divalent organic group, and $R_1$ and $R_2$ each represents a hydrogen atom or another substituent.

The preferred ranges for, and actual example of, Y and Z in general formulae (II) and (III) are the same as those described in connection with general formula (I).

Actual examples of the heterocyclic ring group composed of $-X_1-X_2=X_3-$ and $>N-$ in general formula (II) and examples of the heterocyclic ring group composed of $-C(R_1R_2)-X_4-X_2=X_3-$ and $>N-$, and substituent groups in general formula (III) are taken from among those described in the description of the heterocyclic ring group composed of $X<$ and $>N-$ in general formula (I). Furthermore, the preferred ranges for these groups are also the same. Most preferably, these nitrogen containing heterocyclic rings have condensed benzene rings.

A preferred example of the coupler of the present invention is a nondiffusive coupler. A non-diffusive coupler is a coupler which contains a non-diffusive group so that coupler can be immobilized in the layer in which it has been incorporated. In general, a nondiffusive group is a group which sufficiently adds to the molecular weight of the coupler. As such a nondiffusive group there can be used a $C_{8-30}$, preferably $C_{10-20}$ alkyl group or $C_{4-20}$ substituted aryl group. Such a nondiffusive group may be in any position in the molecule of the coupler. A plurality of such nondiffusive groups may be contained in the coupler.

The coupler of the present invention may or may not contain a dissociative group in any positions other than coupling position. Examples of such a dissociative group include imido group (e.g., —CONHCO—, —$SO_2$NHCO—), phenolic hydroxyl group, sulfonamide group, and carboxyl group.

The couplers represented by general formulae (I), (II) and (III) may form dimers or larger oligomers which are bonded together via divalent groups or groups of valency greater than two in X, Y and Z. In this case, the groups may be outside the ranges for the number of carbon atoms indicated earlier for each substituent group.

Actual examples of couplers of the present invention are indicated below, but the couplers are not limited by these examples.

Illustrative Compounds (1)

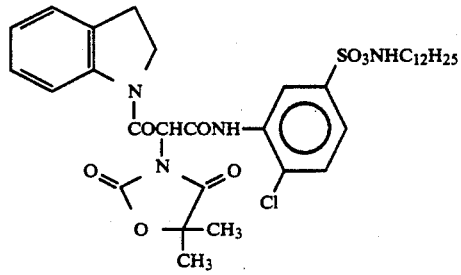

-continued
Illustrative Compounds
(2)
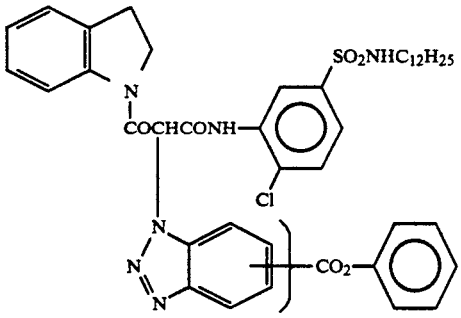
(3)
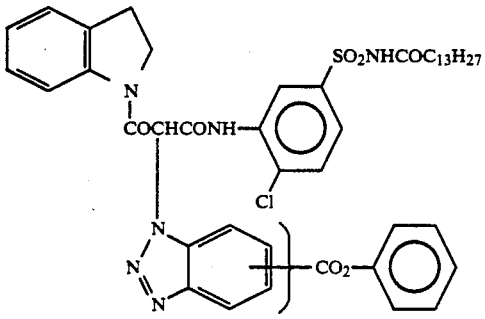
(4)
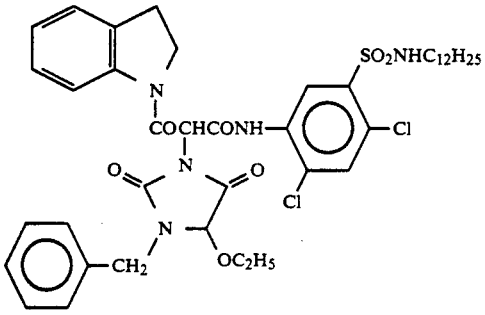
(5)
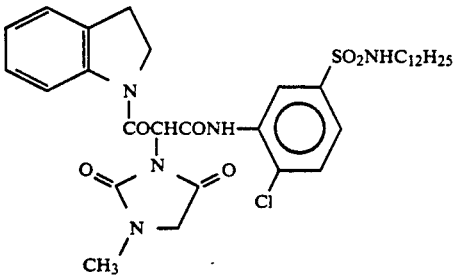
(6)
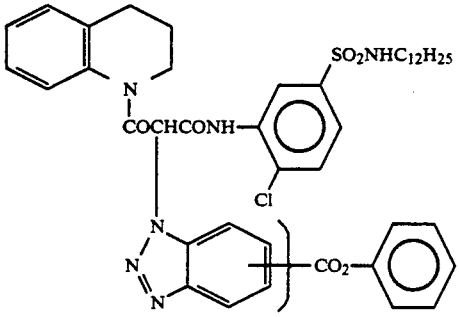

-continued
Illustrative Compounds
(7)
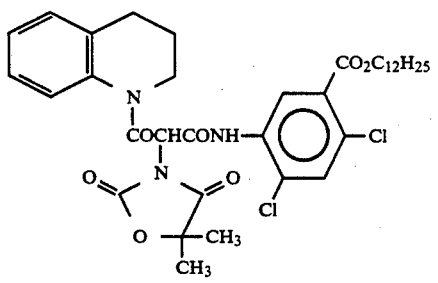
(8)
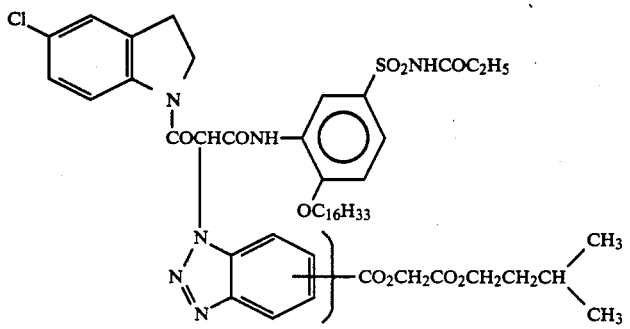
(9)
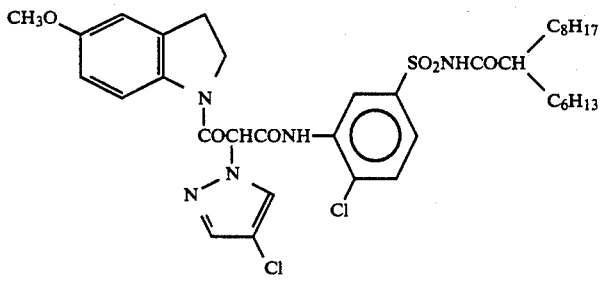
(10)
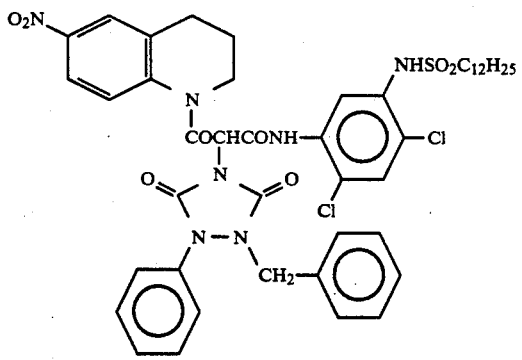
(11)
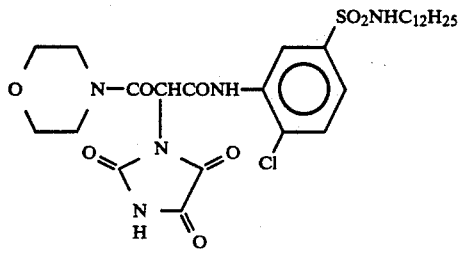

-continued
Illustrative Compounds
(12)
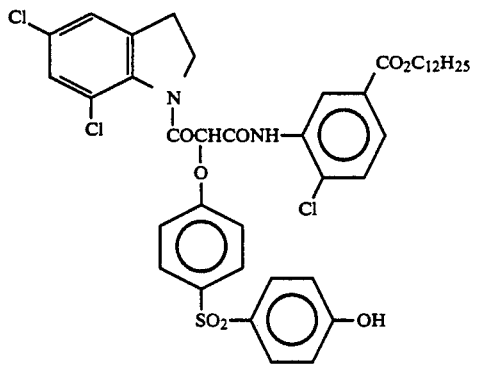
(13)
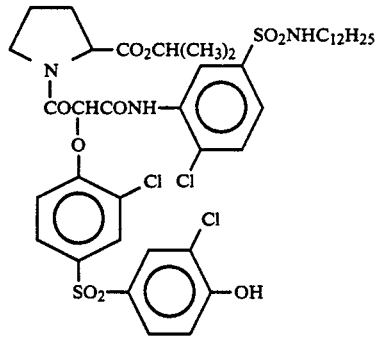
(14)
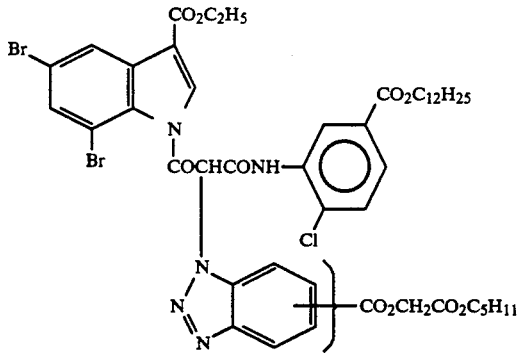
(15)
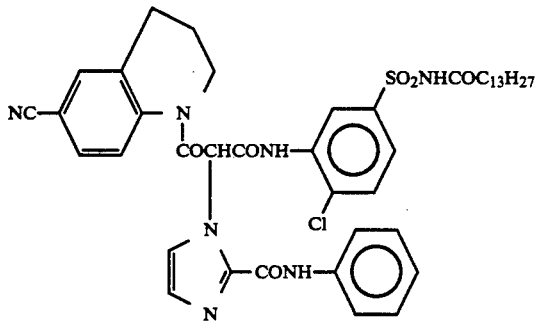

-continued
Illustrative Compounds
(16)
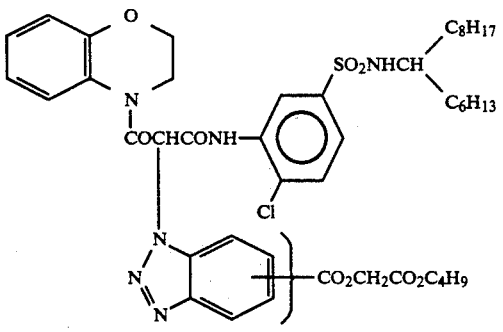
(17)
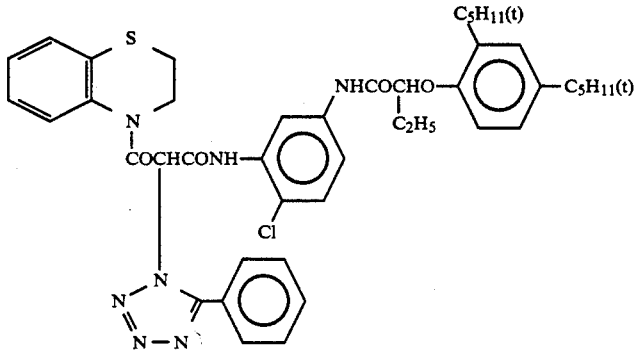
(18)
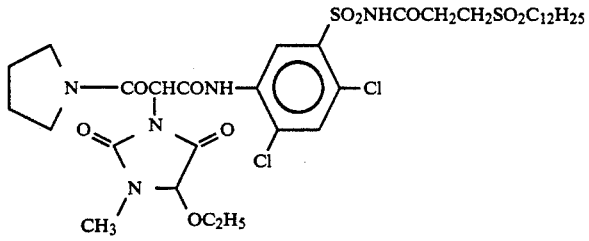
(19)
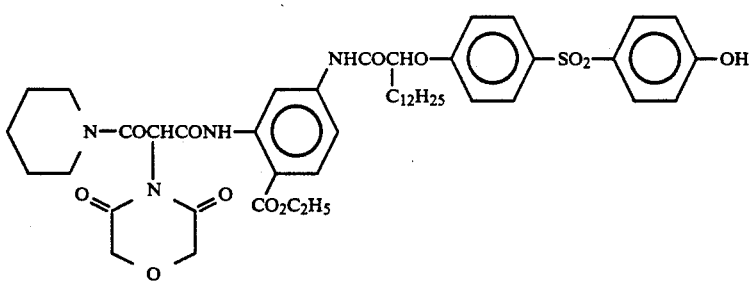
(20)
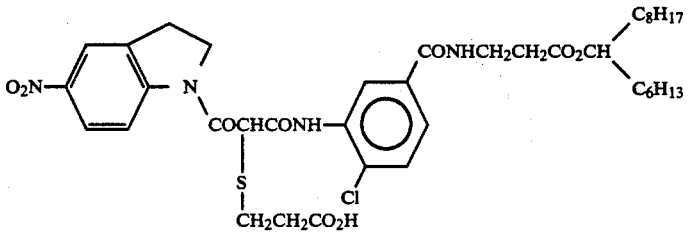

-continued
Illustrative Compounds
(21)
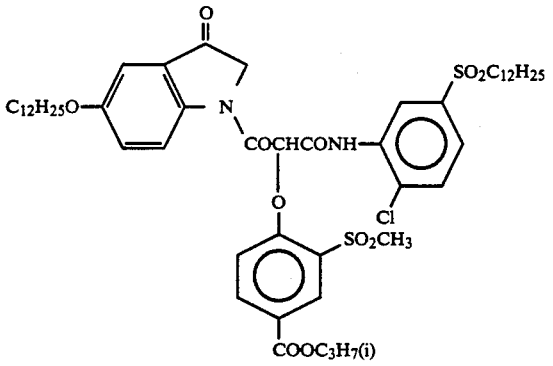
(22)
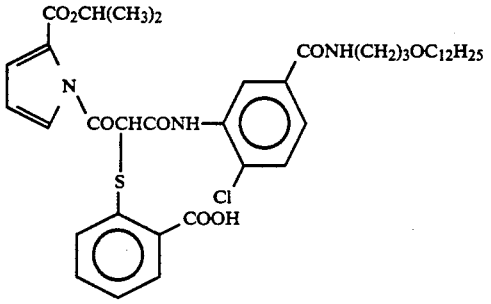
(23)
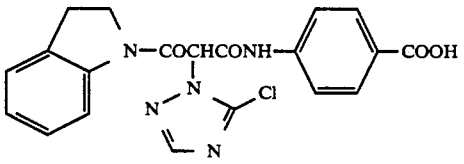
(24)
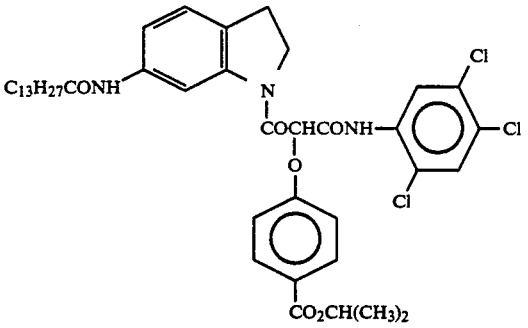
(25)
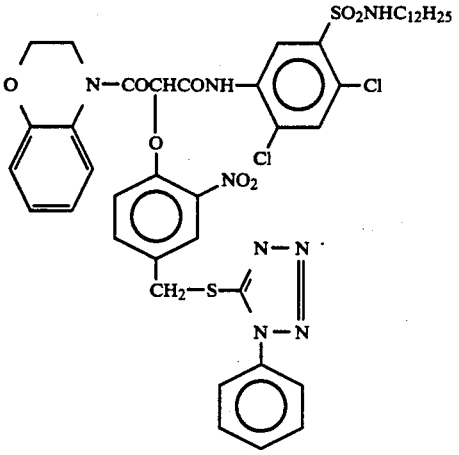

-continued
Illustrative Compounds
(26)
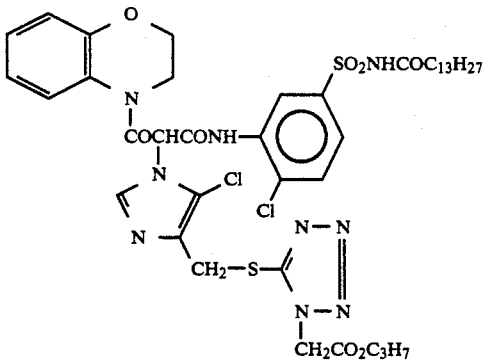
(27)
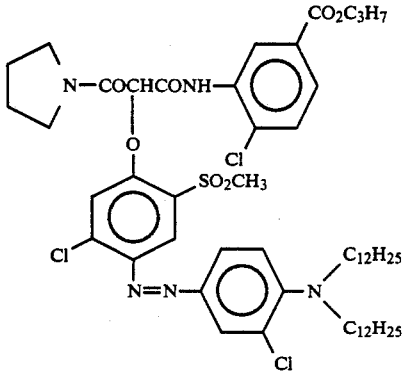
(28)
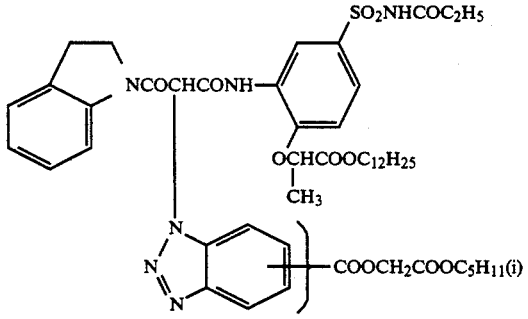
(29)
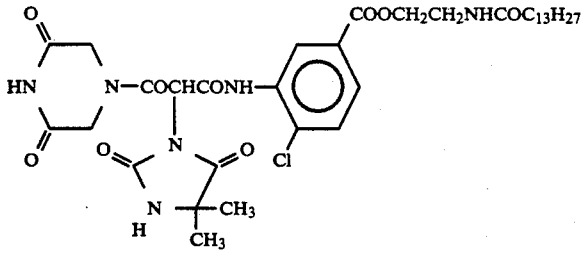
(30)
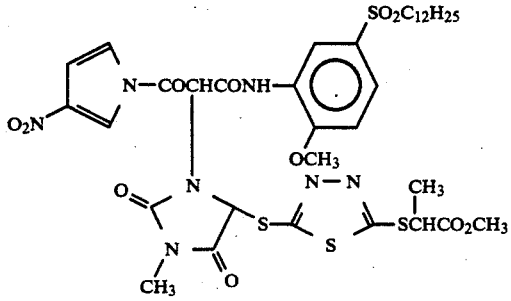

-continued
Illustrative Compounds
(31)
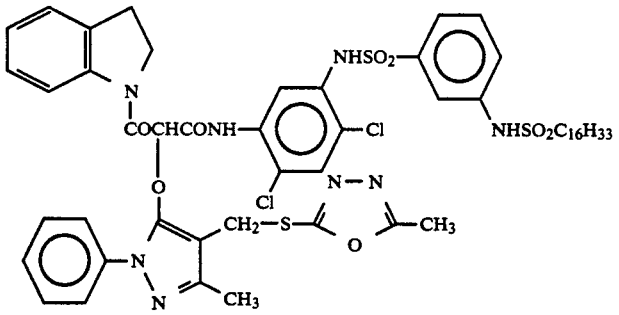
(32)
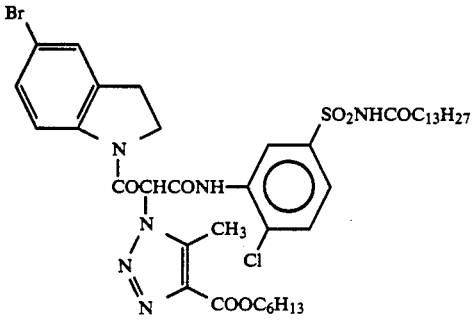
(33)
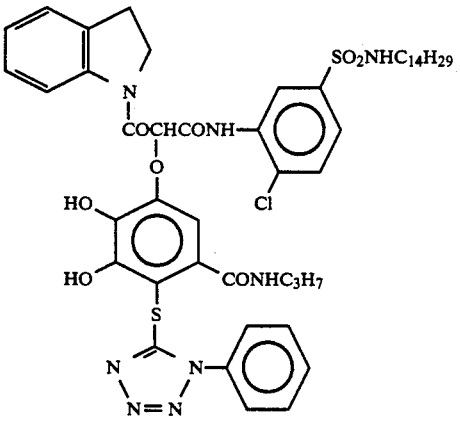
(34)
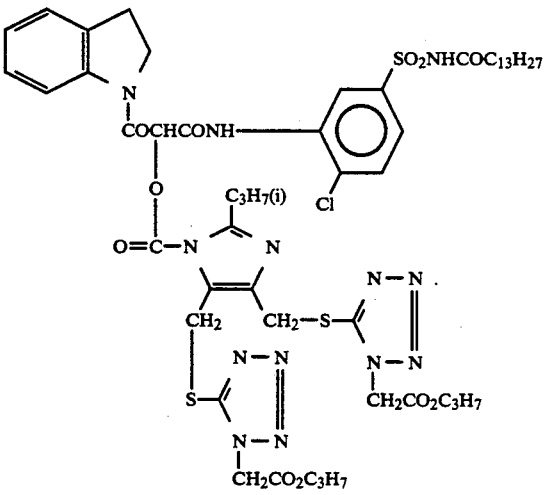

-continued
Illustrative Compounds
(35)
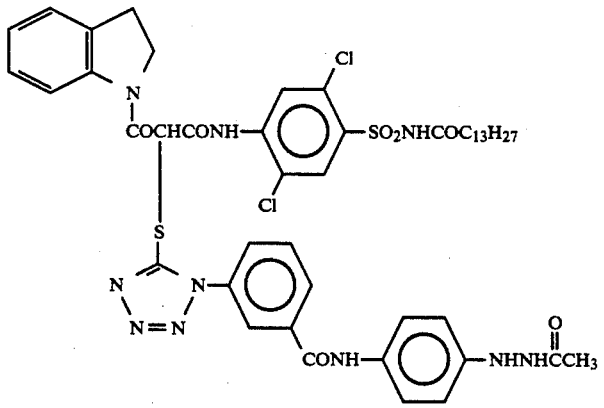
(36)
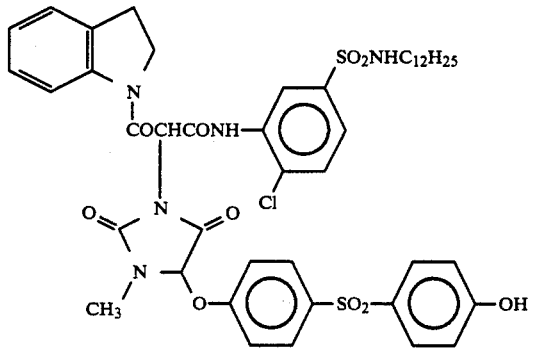
(37)
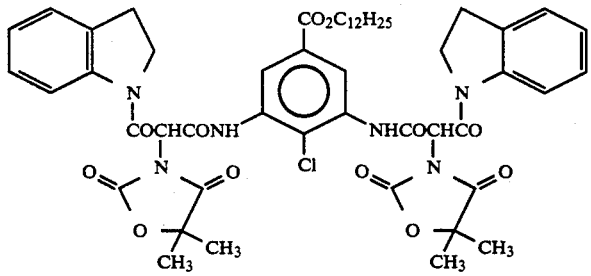
(38)
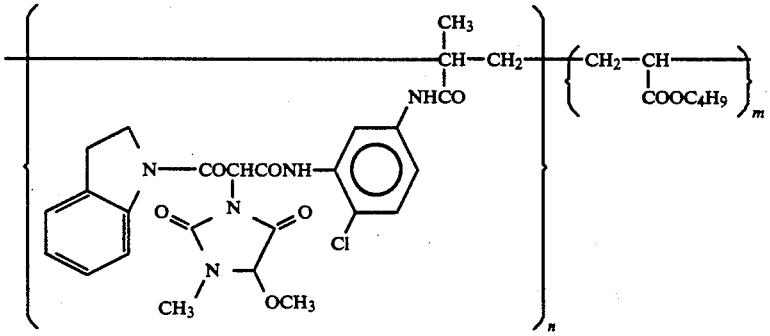
n/m = 50/50 (by weight)
Average Molecular Weight 25,000

-continued
Illustrative Compounds
(39)
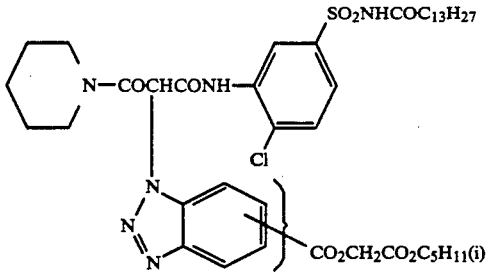
(40)
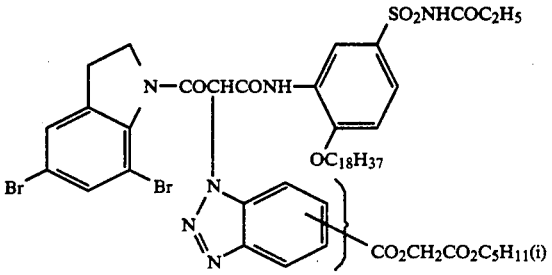
(41)
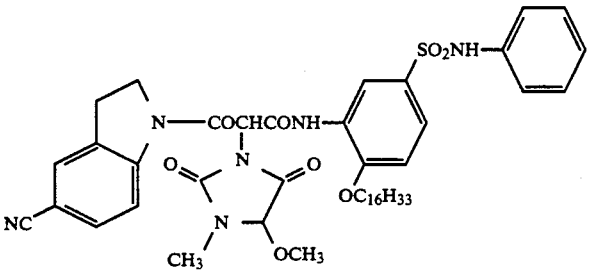
(42)
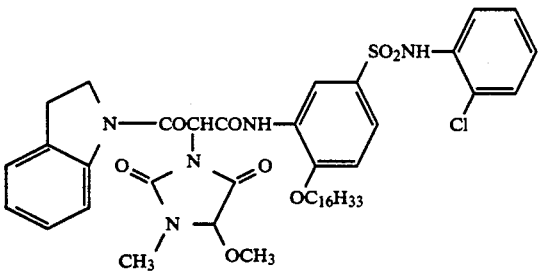
(43)
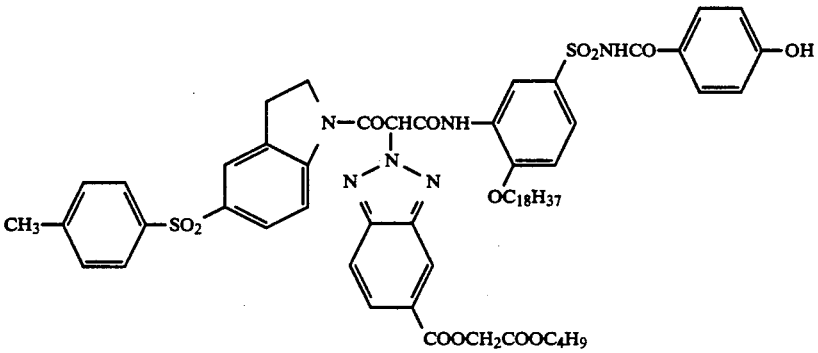

-continued
Illustrative Compounds
(44)
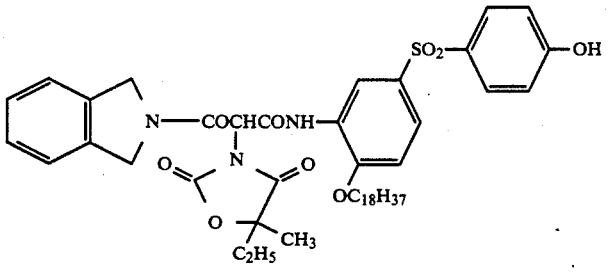
(45)
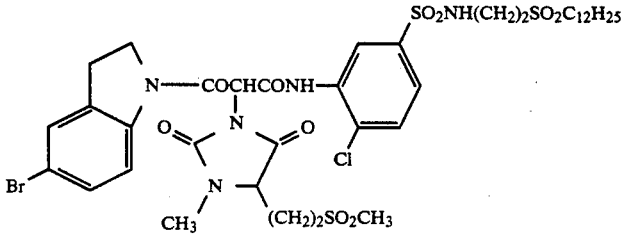
(46)
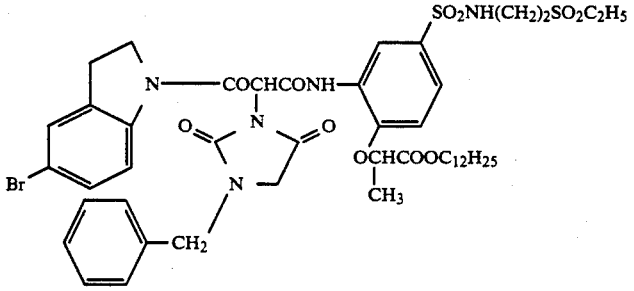
(47)
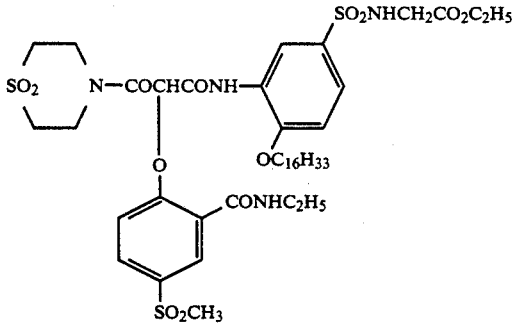
(48)
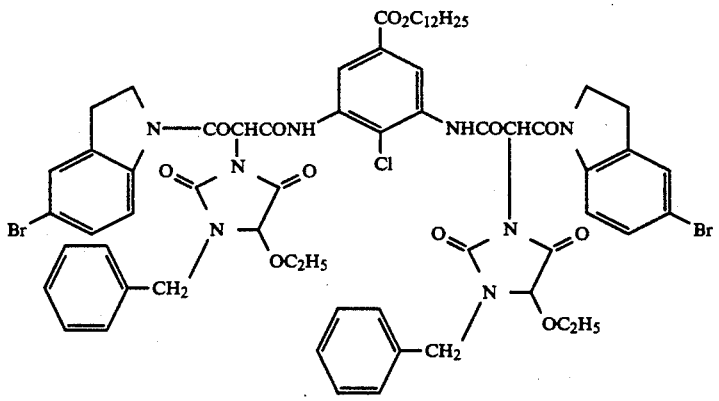

-continued
Illustrative Compounds
(49)
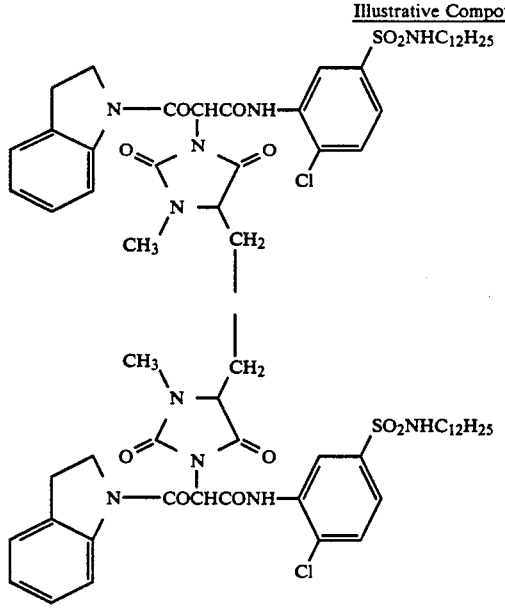
(50)
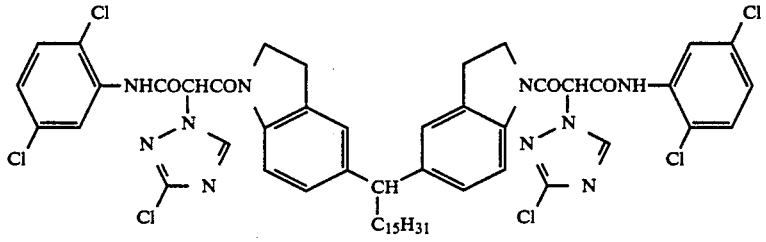
(51)
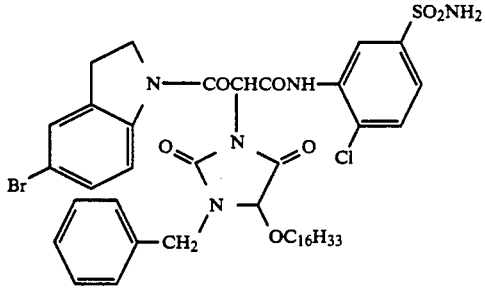
(52)
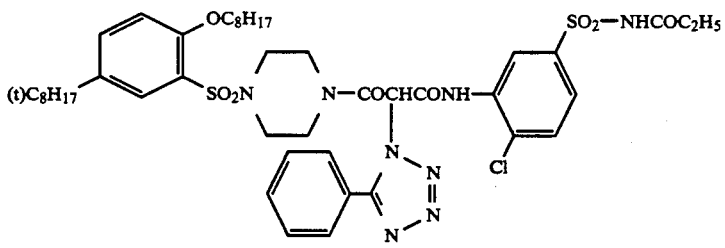
(53)
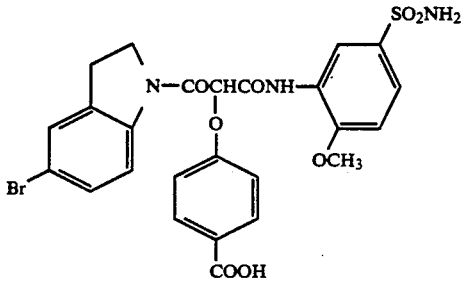

-continued
Illustrative Compounds
(54)
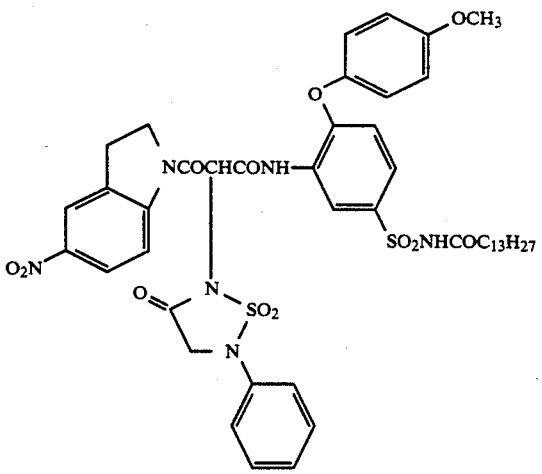
(55)
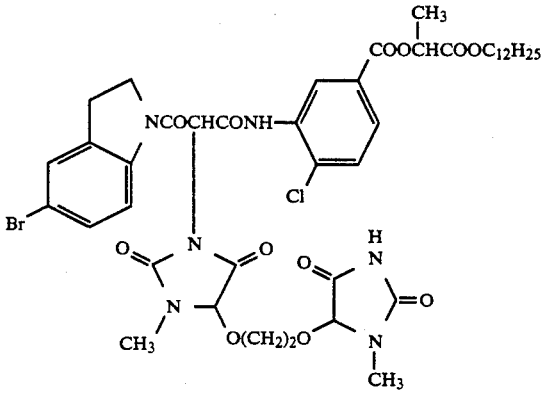
(56)
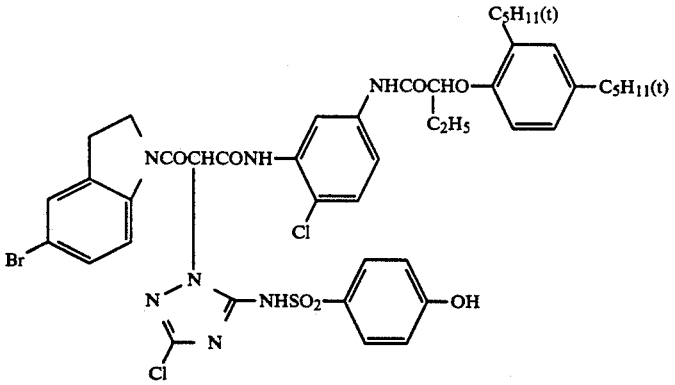
(57)
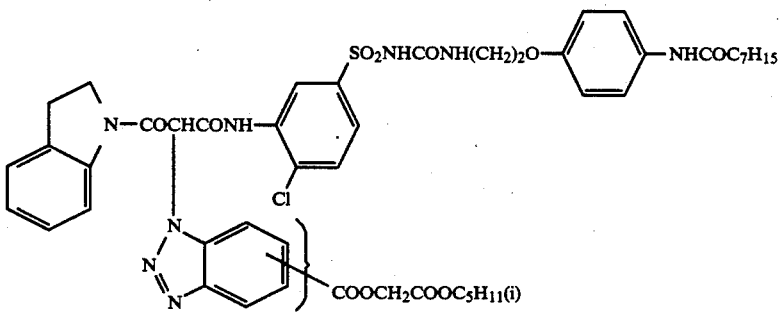

-continued
Illustrative Compounds
(58)
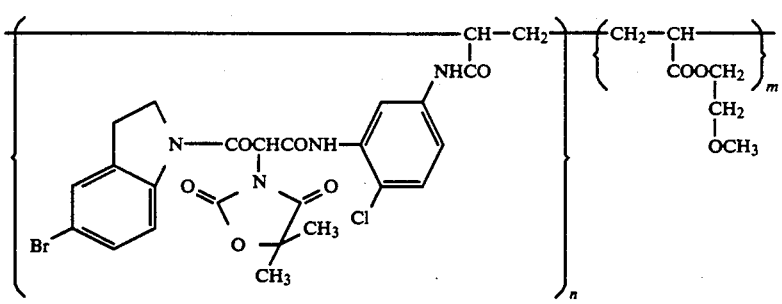
n/m = 60/40 (by weight)
Average molecular weight: 30,000
(59)
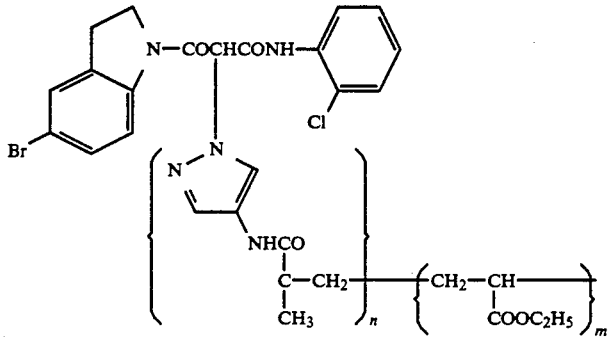
(60)
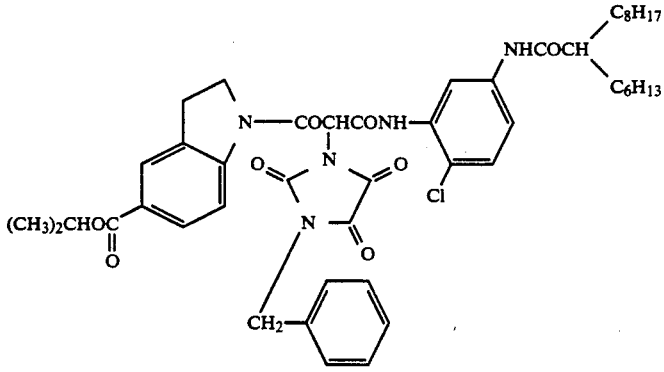
(61)
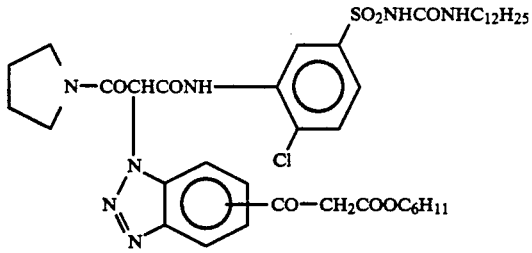
The compounds of this present invention can generally be prepared using methods well known in the past or methods similar to such methods.
For example, they can be prepared using the synthetic pathway indicated below.
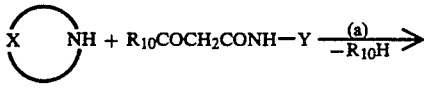
1a 2a
-continued
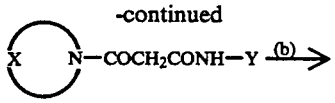
3a
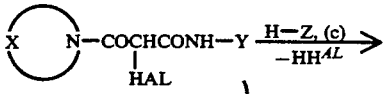
4a -continued

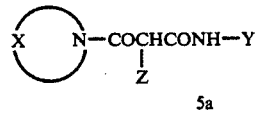

(Compound Represented by General Formula (I))

In these equations, X, Y and Z have the same significance as those described in connection with general formula (I). $R_{10}$ represents a halogen atom (for example chlorine), —OH, an alkoxy group (for example, methoxy, ethoxy) or a phenoxy group (for example, phenoxy, 4-nitrophenoxy). HAL represents a halogen atom. The reaction under conditions (a) is carried out using a dehydrating condensing agent (for example N,N-dicyclohexylcarbodiimide or N,N-diisopropylcarbodiimide) when $R_{10}$ is OH. When $R_{10}$ is a halogen atom the reaction is carried out in the presence of a dehydrohalogenating agent. An organic base (for example, triethylamine, diisopropylethylamine, pyridine, guanidine, potassium butoxide) or an inorganic base (for example, sodium hydroxide, potassium hydroxide, sodium hydride, potassium carbonate), for example, is used as a dehydrohalogenating agent. A halogenating agent is used for (b) in the reaction 3*a*→4*a*. For example, bromine, chlorine, N-bromosuccinimide or N-chlorosuccinimide may be used. A dehydrohalogenating agent is generally used for (c) in the reaction 4*a*→final product. The aforementioned organic and inorganic bases can be cited as examples. A reaction solvent is generally used for each reaction. For example, chlorine based solvents (for example dichloromethane), aromatic solvents (for example, benzene, chlorobenzene, toluene), amide based solvents (for example, N,N-dimethylformamide, N,N-dimethylacetamide, N-methylpyrrolidone), nitrile based solvents (acetonitrile, propionitrile), ether based solvents (for example tetrahydrofuran, ethylene glycol di-ethyl ether), sulfone based solvents (for example dimethylsulfone, sulfolane) or hydrocarbon solvents (for example cyclohexane, n-hexane) can be used as solvents.

They can also be prepared using methods other than the synthetic route indicated above. For example, they can also be prepared using the method described in *J. Org. Chem.*, 29, 2932 (1964). Furthermore, there are cases in which further conversion of functional groups is carried out from 5*a* to derive the final target product. These modifications of the synthetic route and additional reactions can be selected appropriately.

Actual methods of preparation are described below. Other illustrative compounds can also be prepared in the same way.

EXAMPLE OF SYNTHESIS 1

THE PREPARATION OF ILLUSTRATIVE COMPOUND (2)

This is prepared using the method of preparation described below.

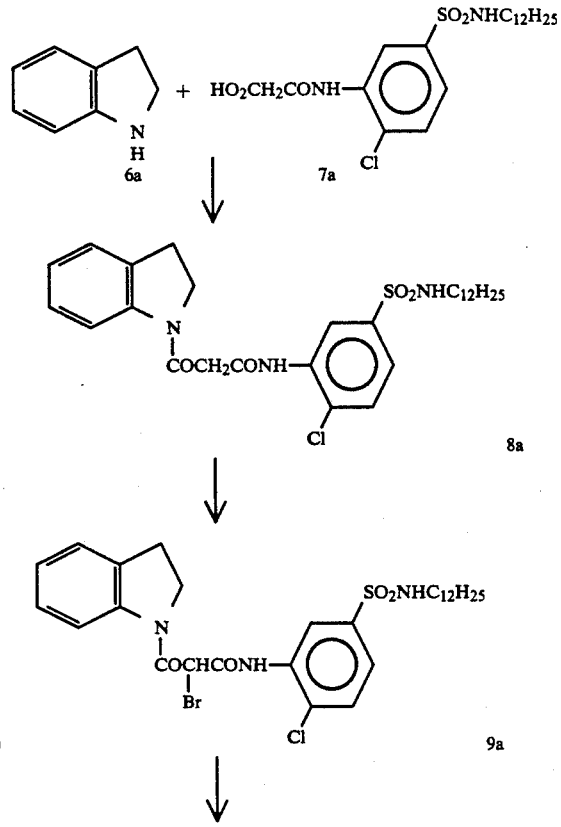

Illustrative Compound (1)

Compound 6*a* (3.5 grams) and 13 grams of 7*a* are dissolved in 100 ml of N-dimethylformamide and 100 ml of acetonitrile. An acetonitrile (40 ml) solution in which 6 grams of N,N'-dicyclohexylcarbodiimide has been dissolved is added dropwise to this solution at room temperature. The N,N'-dicyclohexylurea which precipitated out after reacting for 2 hours is filtered off. The filtrate is poured into 500 ml of water and extracted with 500 ml of ethyl acetate. The oil phase is recovered using a separating funnel and, after washing with water, it is dried over sodium sulfate. The solvent is then distilled off under reduced pressure, hexane is added to the residue and the residue crystallized. 8*a* (16.1 grams) is obtained in this way.

Next, 16 grams of 8*a* is mixed with 150 ml of dichloromethane. A solution of 10 ml of dichloromethane which contained 4.8 grams of bromine is added dropwise with ice cooling (5° C.–10° C.). After reacting for 10 minutes, the mixture is transferred to a separating funnel and washed with water. The oil phase (a solution containing 9*a*) is recovered and used without further treatment in the next process.

Phenoxycarbonylbenzotriazole (15 grams) and 8.8 ml of triethylamine are added to 160 ml of N,N-dimethylformamide. The aforementioned dichloromethane solution of 9*a* obtained above is added dropwise into this solution at room temperature. After reacting for 1 hour, 500 ml of ethyl acetate is added and the mixture is transferred to a separating funnel to obtain oil phase and washed with water. After neutralization with dilute hydrochloric acid, the mixture is washed again with water and then the oil layer is separated. The solvent is removed under reduced pressure and the residue is separated and refined using column chromatography. Silica gel is used as the packing material and a mixture of ethyl acetate and hexane (1/1) is used as the eluting solvent. The fractions containing the target illustrative compound (2) are collected and the wax-like illustrative compound (2) (17.6 grams) is obtained on removing the solvent under reduced pressure.

EXAMPLE OF SYNTHESIS 2

THE PREPARATION OF ILLUSTRATIVE COMPOUND (1)

The preparation is carried out in the same way as described above in example of synthesis 1. However, an equimolar quantity of 5,5-dimethyl-2,4-dioxo-1,3-oxazolidine is used in place of the phenoxycarbonylbenzotriazole. The final product is refined using column chromatography and 16.5 grams of wax-like (1) is obtained.

EXAMPLE OF SYNTHESIS 3

THE PREPARATION OF ILLUSTRATIVE COMPOUND (3)

The preparation is carried out in the same way as described above in example of synthesis 1. However, an equimolar quantity of 10*a* indicated below is used in place of 7*a*.

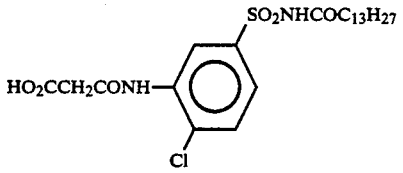

10a

The final product is refined using column chromatography and 18.3 grams of wax-like (3) is obtained.

The yellow couplers of this present invention are preferably added to a photosensitive silver halide emulsion layer or a layer adjacent thereto in the photosensitive material, and they are most preferably added to a photosensitive silver halide emulsion layer. The total amount added to the sensitive material in cases where a development inhibitor component is included in the leaving group X is from 0.001 to 0.80 g/m$^2$, preferably from 0.005 to 0.50 g/m$^2$, and most preferably from 0.02 to 0.30 g/m$^2$. Furthermore, when no development inhibitor component is included in the leaving group X the amount added is from 0.001 to 1.20 g/m$^2$, preferably from 0.01 to 1.00 g/m$^2$, and most preferably from 0.10 to 0.80 g/m$^2$.

The yellow couplers of this present invention can be added in the same way as the ordinary couplers as described hereinafter.

A photosensitive material of this present invention should have established, on a support, at least one blue sensitive silver halide emulsion layer, at least one green sensitive silver halide emulsion layer and at least one red sensitive silver halide emulsion layer, but no particular limitation is imposed upon the number or order of the silver halide emulsion layers and non-photosensitive layers. Typically, a silver halide photographic photosensitive material has, on a support, at least one photosensitive layer comprised of a plurality of silver halide emulsion layers which have essentially the same color sensitivity but different photographic speeds, the said photosensitive layer being a unit photosensitive layer which is color sensitive to blue light, green light or red light, and in a multi-layer silver halide color photographic material the arrangement of the unit photosensitive layers generally involves their establishment in the order, from the support side, of red sensitive layer, green sensitive layer, blue sensitive layer. However, this order may be reversed, as required, and the layers may be arranged in such a way that a layer which has a different color sensitivity is sandwiched between layers which have the same color sensitivity.

Various non-photosensitive layers, such as intermediate layers, may be established between the above mentioned silver halide photosensitive layers, and as uppermost and lowermost layers.

The said intermediate layers may contain couplers and DIR compounds such as those disclosed in the specifications of JP-A-61-43748, JP-A-59-113438, JP-A-59-113440, JP-A-61-20037 and JP-A-61-20038, and they may also contain the generally used anti-color mixing compounds. (The term "JP-A" as used herein signifies an "unexamined published Japanese patent application".)

The plurality of silver halide emulsion layers constituting each unit photosensitive layer is preferably a double layer structure comprised of a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be established between each of the silver halide emulsion layers. Furthermore, the low speed layers may be arranged on the side furthest from the support and the high speed layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, there are arrangements in which there are three layers which have different speeds with the photosensitivity falling towards the support with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495. In the case of structures of this type which have three layers with different photosensitivities, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged, for example, in the order high speed emulsion layer/low speed emulsion layer/intermediate speed emulsion layer, or low speed emulsion layer/intermediate speed emulsion layer/high speed emulsion layer.

Furthermore, the arrangement may be varied in the ways indicated above in cases where there are four or more layers.

As described above, various layer structures and arrangements can be selected respectively according to the purpose of the photosensitive material.

The preferred silver halides for inclusion in the photographic emulsion layers of a photographic photosensitive material used in this present invention are silver iodobromides, silver iodochlorides or silver iodochlorobromides which contain not more than about 30 mol % of silver iodide. Most preferably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine, less than at about 0.2 microns, or large with a projected area diameter of up to about 10 microns, and the emulsions may be poly-disperse emulsions or mono-disperse emulsions.

Silver halide photographic emulsions which can be used in this present invention can be prepared, for example, using the methods disclosed in *Research Disclosure* (RD) No. 17643 (December, 1978), pages 22–23, "I. Emulsion Preparation and Types", *Research Disclosure* No. 18716 (November 1979), page 648, and *Research Disclosure*, No. 307105 (November 1989), pages 863–865, by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsions*, published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in this present invention. Tabular grains can be prepared easily using the methods described, for example, by Gutoff in *Photographic Science and Engineering*, Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide. Furthermore, mixtures of grains which have various crystalline forms may be used.

The above mentioned emulsions may be of the surface latent image type in which the latent image is formed principally on the surface, the internal latent image type in which the latent image is formed within the grains, or of a type in which the latent image is formed both at the surface and within the grains, but a negative type emulsion is essential. From among the internal latent image types the emulsion may be a core/shell internal latent image type emulsion as disclosed in JP-A-63-264740. A method for the preparation of such a core/shell internal latent image type emulsion has been disclosed in JP-A-59-133542. The thickness of the shell of this emulsion differs according to the development processing, for example, but is preferably from 3 to 40 nm, and most preferably from 5 to 20 nm.

The silver halide emulsions used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution, halogen composition of the photosensitive silver halide emulsion, the grain form or photographic speed can be used in the form of a mixture in the same layer in a photosensitive material of this present invention.

The use of silver halide grains of which the grain surface has been fogged as disclosed in U.S. Pat. No. 4,082,553, silver halide grains of which the grain interior has been fogged as disclosed in U.S. Pat. No. 4,626,498 and JP-A-59-214852 or colloidal silver is preferable in the photosensitive silver halide emulsion layers and/or essentially non-photosensitive hydrophilic colloid layers. Silver halide grains of which the grain interior or surface has been fogged are silver halide grains which can be developed uniformly (not in the form of the image) irrespective of whether they are in an unexposed part or an exposed part of the photosensitive material. Methods for the preparation of silver halide grains in which the interior or surface of the grains has been fogged have been disclosed in U.S. Pat. No. 4,626,498 and JP-A-59-214852.

The silver halide which forms the internal nuclei of core/shell type silver halide grains in which the grain interior has been fogged may have the same halogen composition or a different halogen composition. The silver halide in which the grain interior or surface has been fogged may be silver chloride, a silver chlorobromide, a silver iodobromide or a silver chloroiodobromide. No particular limitation is imposed upon the grain size of these fogged silver halide grains, but an average grain size of from 0.01 to 0.75 μm, and especially of from 0.05 to 0.6 μm, is preferred. Furthermore, no particular limitation is imposed upon the form of the grains and they may be regular grains, and they may be polydisperse emulsions, but monodisperse emulsions (in which at least 95% in terms of the weight or number of silver halide grains have a grain size within ±40% of the average grain size) are preferred.

The use of non-photosensitive fine grained silver halides is preferable in this present invention. Non-photosensitive fine grained silver halides are fine grained silver halides which are not photosensitive at the time of the imagewise exposure for obtaining the dye image and which undergo essentially no development during development processing, and those which have not been pre-fogged are preferred.

The fine grained silver halide has a silver bromide content from 0 to 100 mol %, containing silver chloride and/or silver iodide as required. Those which have a silver iodide content of from 0.5 to 10 mol % are preferred.

The fine grained silver halide has an average grain size (the average value of the diameters of the circles corresponding to the projected areas) preferably of from 0.01 to 0.5 μm, and most desirably of from 0.02 to 0.2 μm.

The fine grained silver halide can be prepared using the same methods as used in general for the preparation of photosensitive silver halides. In this case, the surface of the silver halide grains does not need to be optically sensitized and neither is there any need for spectral sensitization. However, the pre-addition of known stabilizers such as triazole, azaindene, benzothiazolium or mercapto based compounds or zinc compounds before addition to the coating liquid is desirable. Colloidal silver can also be included desirably in the layer which contains these fine grained silver halide grains.

The coated weight of silver in a photosensitive material of this present invention is preferably not more than 6.0 g/m$^2$, and most preferably not more than 4.5 g/m$^2$.

Known photographically useful additives which can be used in this present invention have also been disclosed in the three *Research Disclosures* referred to above, and the locations of these disclosures are also indicated in the table below.

The inclusion of compounds disclosed in JP-A-1-106052 which release fogging agents, development accelerators, silver halide solvents or precursors of these materials irrespective of the amount of developed silver produced by development processing in a photosensitive material of this present invention is desirable.

The inclusion of the dyes dispersed in a photosensitive material of this present invention using the methods disclosed in International Patent laid open WO88/04794 and JP-A-1-502912, or the dyes disclosed in EP 317,308A, U.S. Pat. No. 4,420,555 and JP-A-1-259358 is desirable.

Various color couplers can be used in this present invention, and actual examples have been disclosed in the patents cited in the aforementioned *Research Disclosure* No. 17643, sections VII-C–G, and No. 307105, sections VII-C–G.

Those disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO 88/04795 are especially desirable.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Super-Sensitizers | Pages 23–24 | Page 648 right hand column - page 649 right hand column | Pages 866–868 |
| 4. Bleaching Agents | Page 24 | Page 647, right hand column | Page 868 |
| 5. Anti-foggants, Stabilizers | Pages 24–25 | Page 649, right hand column | Pages 868–870 |
| 6. Light Absorbers, Filter Dyes and Ultraviolet absorbers | Pages 25–26 | Page 649, right hand column - page 650, left hand column | Page 873 |
| 7. Anti-staining Agents | Page 25, right hand column | Page 650, left hand column - right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors Surfactants | Pages 26–27 | Page 650, right hand column | Pages 875–876 |
| 13. Anti-static agents | Page 27 | Page 650, right hand column | Pages 876–877 |
| 14. Matting Agents | | | Pages 878–879 |

Furthermore, addition of the compounds disclosed in U.S. Pat. Nos. 4,411,987 and 4,435,503 which can react with and fix formaldehyde to the photosensitive material is desirable for preventing deterioration of photographic performance due to formaldehyde gas.

The inclusion of the mercapto compounds disclosed in U.S. Pat. Nos. 4,740,454 and 4,788,132, JP-A-62-18539 and JP-A-1-283551 in a photosensitive material of this present invention is desirable.

Phenol and naphthol based couplers can be cited as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent laid open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. Moreover, the pyrazoloazole based couplers disclosed in JP-A-64-553, JP-A-64-554, JP-A-64-555 and JP-A-64-556, and the imidazole based couplers disclosed in U.S. Pat. No. 4,818,672 can also be used.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

The colored couplers for correcting the unwanted absorptions of colored dyes disclosed, for example, in section VII-G of *Research Disclosure* No. 17643, section VII G of *Research Disclosure* No. 307105, U.S. Pat. No. 4,163,670, JP-B-57-39413, U.S. Pat. Nos. 4,004,929 and 4,138,258, and British Patent 1,146,368 are desirable. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120 is also desirable.

The use of couplers which release photographically useful residual groups on coupling is also desirable in this present invention. The DIR couplers which release development inhibitors disclosed in the patents cited in section VII-F of the aforementioned *Research Disclosure* 17643, section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012 are desirable.

The bleaching accelerator releasing couplers disclosed in R.D. No. 11449, R.d. No. 24241 and JP-A-61-201247 are effective for shortening the time of the processing operation which has a bleaching function, are they are particularly effective in cases where they are added to photosensitive materials in which the aforementioned tabular silver halide grains are used.

The couplers disclosed in British Patents 2,097,140 and 2,131,188, JP-A-59-157638 and JP-A-59-170840 are preferred as couplers which release nucleating agents or development accelerators in the form of the image during development. Furthermore, the compounds which release fogging agents, development accelerators, silver halide solvents, etc., by means of a redox reaction with the oxidized form of a developing agent disclosed in JP-A-60-107029, JP-A-60-252340, JP-A-1-44940 and JP-A-1-45687 are also desirable.

Other compounds which can be used in photosensitive materials of this present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after elimination disclosed in European Patents 173,302A and 313,308A, the ligand releasing couplers disclosed, for example, in U.S. Pat. 4,555,477, the leuco dye releasing couplers disclosed in JP-A-63-75747, and the couplers which release fluorescent dyes disclosed in U.S. Pat. No. 4,774,181.

The couplers used in this present invention can be introduced into the photosensitive material using a variety of known methods.

Examples of high boiling point solvents which can be used in the oil in water dispersion method have been disclosed, for example, in U.S. Pat. No. 2,322,027.

Actual examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl) isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, iso-stearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene). Furthermore, organic solvents which have a boiling point of about 30° C. or more, and preferably of at least 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and actual examples of latexes for loading purposes have been disclosed, for example, in U.S. Pat. No. 4,199,363, and in West German Patent Applications (OLS) 2,541,274 and 2,541,230.

The addition to the color photosensitive materials of this present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole for example as disclosed in JP-A-63-257747, JP-A-62-272248 and JP-A-1-80941 is desirable.

This present invention can be applied to a variety of color photosensitive materials. Typical examples include color negative films for general and cinematographic purposes, color reversal films for slides and television purposes, color papers, color positive films and color reversal papers.

Suitable supports which can be used in this present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105.

The photosensitive materials of this present invention are such that the total film thickness of all the hydrophilic colloid layers on the side where the emulsion layers are located is preferably not more than 28 μm, more preferably not more than 23 μm, even more preferably not more than 18 μm, and most preferably not more than 16 μm. Furthermore, the film swelling rate $T_{\frac{1}{2}}$ is preferably not more than 30 seconds and most preferably not more than 20 seconds. Here, the film thickness signifies the film thickness measured under conditions of 25° C., 55% relative humidity (2 days) and the film swelling rate $T_{\frac{1}{2}}$ is that measured using the methods well known to those in the industry. For example, measurements can be made using a swellometer of the type described by A. Green in *Photogr. Sci. Eng.*, Volume 19, Number 2, pages 124–129, and $T_{\frac{1}{2}}$ is defined as the time taken to reach half the saturated film thickness, taking 90% of the maximum swelled film thickness reached on processing the material for 3 minutes 15 seconds in a color developer at 30° C. as the saturated film thickness.

The film swelling rate $T_{\frac{1}{2}}$ can be adjusted by adding film hardening agents for the gelatin which is used as a binder, or by changing the aging conditions after coating. Furthermore, a swelling factor of from 150% to 400% is preferred. The swelling factor can be calculated from the maximum swelled film thickness obtained under the conditions described above using the expression (maximum swelled film thickness minus film thickness)/film thickness.

The establishment of a hydrophilic colloid layer (known as a backing layer) of total dry film thickness from 2 μm to 20 μm on the side opposite from the emulsion layers is preferable in a photosensitive material of this present invention. The inclusion of light absorbing agents, filter dyes, ultraviolet absorbers, anti-static agents, film hardening agents, binders, plasticizers, lubricants, coating promotors and surfactants, for example, as described before, in this backing layer is preferable. The swelling factor of the backing layer is preferably from 150% to 500%.

Color photographic photosensitive materials which are in accordance with this present invention can be developed and processed using the general methods disclosed on pages 28–29 of the aforementioned *Research Disclosure* No. 17643, from the left hand column to the right hand column of page 651 of the aforementioned *Research Disclosure* No. 18716, and on pages 880 to 881 of the aforementioned *Research Disclosure* No. 307105.

The color developers used for the development processing of photosensitive materials of this present invention are preferably aqueous alkaline solutions which contain a primary aromatic amine based color developing agent as the principal component. Aminophenol based compounds are also useful as color developing agents, but the use of p-phenylenediamine based compounds is preferred, and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. From among these compounds, 3-methyl-4-amino-N-ethyl-N-β-hydroxyethylaniline sulfate is especially preferable. Two or more of these compounds can be used conjointly, according to the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxy-ethylidene-1,1-diphosphonic acid, nitrilo-N,N,N-trimethylene-phosphonic acid, ethylenediamine-N,N,N,N-tetramethylene-phosphonic acid, ethylenediamine-di(o-hydroxyphenylacetic acid) and salts of these acids.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone, and aminophenols such as N-methyl-p-aminophenol, for example, can be used individually, or in combinations, in the black and white developer.

The pH of these color developers and black and white developers is generally from 9 to 12. Furthermore, the replenishment rate for these developers depends on the color photographic photosensitive material which is being processed but, in general, it is not more than 3 liters per square meter of photosensitive material, and it can be set to not more than 500 ml by reducing the bromide ion concentration in the replenisher. In those cases where the replenishment rate is low it is desirable that evaporation and aerial oxidation of the liquid should be prevented by minimizing the area of contact with the air in the processing tank.

The contact area between the air and the photographic processing bath in a processing tank can be represented by the open factor which is defined below. Thus:

$$\text{Open Factor} = \frac{\text{Processing bath and Air Contact Area (cm}^2\text{)}}{\text{Processing Bath Volume (cm}^3\text{)}}$$

The above mentioned open factor is preferably not more than 0.1, and most preferably from 0.001 to 0.05. The establishment of a shielding material such as a floating lid for example on the surface of the photographic processing bath in the processing tank, the method involving the use of a movable lid as disclosed in JP-A-1-82033 and the method involving the slit development processing disclosed in JP-A-63-216050 can also be used as means of reducing the open factor. Reduction of the open factor is preferably applied not only to the processes of color development and black and white development, but also to all the subsequent processes, such as the bleaching, bleach-fixing, fixing, water washing and stabilizing processes for example. Furthermore, the replenishment rate can be reduced by using some means of suppressing the accumulation of bromide ion in the development bath.

The color development processing time is generally set between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (in a bleach-fix process) or it may be carried out separately. Moreover, a bleach-fix process can be carried out after a bleaching process in order to speed up processing. Moreover, processing can be carried out in two connected bleach-fix baths, a fixing process can be carried out before a bleach-fixing process or a bleaching process can be carried out after a bleach-fix process, as required. Compounds of multivalent metals, such as iron(III) for example, peracids, quinones and nitro compounds can be used as bleaching agents. Typical bleaching agents include organic complex salts of iron(III), for example complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid. From among these materials, the use of aminopolycarboxylic acid iron(III) complex salts, and principally of ethylenediamine tetra-acetic acid iron(III) complex salts and 1,3-diaminopropane tetra-acetic acid iron(III) salts, is preferred from the points of view of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix pre-baths. Actual examples of useful bleach accelerators have been disclosed in the following specifications: Thus, there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (June 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and the bromide ion. (The term "JP-B" as use herein signifies an "examined Japanese patent publication".) From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the sensitive material. These bleaching accelerators are especially effective when bleach-fixing camera color photosensitive materials.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable for the organic acids, and in practice acetic acid, propionic acid and hydroxyacetic acid, for example, are preferred.

Thiosulfate, thiocyanate, thioether based compounds, thioureas and large amounts of iodide can be used, for example, as the fixing agent which is used in a fixing bath or bleachfix bath, but thiosulfate is generally used, and ammonium thiosulfate in particular can be used in the widest range of applications. Furthermore, the conjoint use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths.

The addition of compounds of pKa from 6.0 to 9.0, and preferably imidazoles such as imidazole, 1-methylimidazole, 1-ethylimidazole and 2-methylimidazole, in amounts of from 0.1 to 10 mol/liter to the fixing bath or bleach-fixing baths is preferable for adjusting pH value in this present invention.

A short total de-silvering processing time within the range where de-silvering failure does not occur is preferred. The de-silvering time is preferably from 1 to 3 minutes, and most preferably from 1 to 2 minutes. Furthermore, the processing temperature is from 25° C. to 50° C., and preferably from 35° C. to 45° C. The de-silvering rate is improved and the occurrence of staining after processing is effectively prevented within the preferred temperature range.

Agitation as strongly as possible during the desilvering process is preferable. Actual examples of methods of strong agitation include the methods in which a jet of processing liquid is made to impinge on the emulsion surface of the photosensitive material as disclosed in JP-A-62-183460, the method in which the agitation effect is increased using a rotary device as disclosed in JP-A-62-183461, the method in which the photosensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which are used for photosensitive materials of this present invention preferably have photosensitive material transporting devices as disclosed in JP-A-60-191257, JP-A-60-191258 or JP-A-60-191259. With such a transporting device, such as that disclosed in the aforementioned JP-A-60-191257, the carry-over of processing liquid from one bath to the next is greatly reduced and this is very effective for preventing deterioration in processing bath performance. These effects are especially effective for shortening the processing time in each process and for reducing the replenishment rate of each processing bath.

The silver halide color photographic photosensitive materials of this invention are generally subjected to a water washing process and/or stabilizing process after the de-silvering process. The amount of wash water used in the washing process can be fixed within a wide range, depending on the application and the nature (depending on the materials such as couplers which have been used for example) of the photosensitive material, the wash water temperature, the number of water washing tanks (the number of water washing stages) and the replenishment system, i.e., whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers*, Volume 64 (May 1955).

The amount of wash water used can be greatly reduced by using the multi-stage counter-flow system noted in the aforementioned literature, but bacteria proliferate due to the increased residence time of the water in the tanks and problems arise with the suspended matter which is produced becoming attached to the photosensitive material. The method in which the calcium ion and magnesium ion concentrations are reduced, disclosed in JP-A-62-288838, is very effective as a means of overcoming this problem when processing color photosensitive materials of this present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sanko Shuppan), in *Killing Micro-organisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used in this connection.

The pH value of the washing water when processing photosensitive materials of this present invention is from 4 to 9, and preferably from 5 to 8. The washing water temperature and the washing time can be set variously in accordance with the nature and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process, and the stabilizing baths which contain dye stabilizing agents and surfactants which are used as final baths with camera color photosensitive materials are an example of such a process. Aldehydes such as formalin and glutaraldehyde, N-methylol compounds, hexamethylenetetramine and aldehyde/bisulfite addition compounds can be used, for example, as dye stabilizing agents.

Various chelating agents and fungicides can also be added to these stabilizing baths.

The overflow which accompanies replenishment of the above mentioned water washing or stabilizing baths can be reused in other processes, such as the desilvering process.

Concentration correction with the addition of water is desirable, for example, in cases where the above mentioned processing baths become concentrated due to evaporation when processing in an automatic processor.

Color developing agents can be incorporated into a silver halide color photosensitive material of this present invention with a view toward simplifying and speeding up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599, *Research Disclosure* No. 14850 and *Research Disclosure* No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into a silver halide color photosensitive material of this present invention with a view accelerating color development. Typical compounds have been disclosed, for example, in JP-A-56-64339, JP-A-57-144547 and JP-A-58-115438.

The various processing baths in this present invention are used at a temperature of from 10° C. to 50° C. The standard temperature is generally from 33° C. to 38° C., but accelerated processing and shorter processing times can be realized at higher temperatures while, on the other hand, increased picture quality and better processing bath stability can be achieved at lower temperatures.

Furthermore, the silver halide photosensitive materials of this present invention can also be used in the heat developable photosensitive materials disclosed, for example, in U.S. Pat. Nos. 4,500,626, JP-A-60-133449, JP-A-59-218443, JP-A-61-238056 and European Patent 210,660A2.

ILLUSTRATIVE EXAMPLES

The invention is described in detail below by means of illustrative examples, but the invention is not limited by these examples.

EXAMPLE 1

Photosensitive material 101 is prepared by coating each of the layers of which the compositions are indicated below on a poly(ethylene terephthalate) support on which an under-layer has been established.

| | |
|---|---|
| (1) Emulsion Layer | |
| Tabular Emulsion (10 mol % silver iodide, average aspect ratio 7.5, average grain diameter 0.85 μm) | as silver 1.70 g/m² |
| Comparative Coupler C-1 | 0.82 g/m² |
| Tricresyl phosphate | 0.30 g/m² |
| Gelatin | 2.80 g/m² |
| (2) Protective Layer | |
| 2,4-Dichloro-6-hydroxy-s-triazine, sodium salt | 0.10 g/m² |
| Gelatin | 1.8 g/m² |

SAMPLES 102–110

Samples 102 to 110 are prepared by replacing the comparative coupler (C-1) which is added to the emulsion layer of sample 101 with equimolar amounts of the couplers indicated in Table 1.

These samples are subjected to a white light exposure for sensitometric purposes and then they were color developed and processed as indicated below. The yellow densities of the developed samples are measured and the relative speeds indicated by the logarithm of the reciprocal of the exposure required to provide a density of (fog+0.2) and the maximum color densities are obtained. Furthermore, the spectral absorbances of the yellow dyes are measured at the maximum color density and the peak wavelength and the ratio of the absorbance ($D_{520nm}$) at 520 nm and the absorbance at the peak wavelength ($D_{\lambda max}$) are obtained and the results were as shown in Table 1.

Furthermore, after making these measurements the samples are stored for 7 days under conditions of 60° C., 70% relative humidity and then the densities are measured again and the fall in density at the maximum color density is obtained in each case.

The development processing operations used here are carried out at 38° C. under the following conditions.

| | |
|---|---|
| 1. Color Development | 2 minutes 15 seconds |
| 2. Bleaching | 6 minutes 30 seconds |
| 3. Water Washing | 3 minutes 15 seconds |
| 4. Fixing | 6 minutes 30 seconds |
| 5. Water Washing | 3 minutes 15 seconds |
| 6. Stabilization | 3 minutes 15 seconds |

The composition of the processing bath used in each process is as indicated below.

| | |
|---|---|
| Color Developer | |
| Nitrilo tri-acetic acid, sodium salt | 1.0 gram |
| Sodium sulfite | 4.0 grams |
| Sodium carbonate | 30.0 grams |
| Potassium bromide | 1.4 grams |
| Hydroxylamine sulfate | 2.4 grams |
| 4-(N-Ethyl-N-β-hydroxyethylamino)-2-methylaniline sulfate | 4.5 grams |
| Water to make up to | 1 liter |
| Bleach | |
| Ammonium bromide | 160.0 grams |
| Aqueous ammonia (28%) | 25.0 ml |
| Ethylene diamine tetra-acetic acid, sodium iron salt | 130 grams |
| Glacial acetic acid | 14 ml |
| Water to make up to | 1 liter |
| Fixer | |
| Sodium tetrapolyphosphate | 2.0 grams |
| Sodium sulfite | 4.0 grams |
| Ammonium thiosulfate (70%) | 175.0 ml |
| Sodium bisulfite | 4.6 grams |
| Water to make up to | 1 liter |
| Stabilizer | |
| Formalin | 2.0 ml |
| Water to make up to | 1 liter |

TABLE 1

| Sample | Coupler | Relative Speed | Maximum Color Density | Peak Absorption Wavelength (nm) | $D_{520\,nm}$ $D_{\lambda max}$ (%) | Colored Image Storage Properties (Fall in Density) |
|---|---|---|---|---|---|---|
| 101 (Comparative Example) | C-1 | 0.00 | 2.52 | 452 | 15.2 | 0.14 |
| 102 (Comparative Example) | C-2 | −0.03 | 2.04 | 449 | 12.5 | 0.03 |
| 103 (Comparative Example) | C-3 | −0.05 | 2.00 | 450 | 12.8 | 0.02 |
| 104 (Comparative Example) | C-4 | −0.05 | 1.97 | 450 | 13.0 | 0.02 |
| 105 (Comparative Example) | C-5 | 0.01 | 2.34 | 447 | 19.3 | 1.45 |
| 106 (This Invention) | (1) | 0.04 | 2.73 | 452 | 11.1 | 0.02 |
| 107 (This Invention) | (4) | 0.03 | 2.72 | 452 | 10.8 | 0.02 |
| 108 (This Invention) | (9) | 0.02 | 2.73 | 449 | 10.7 | 0.02 |
| 109 (This Invention) | (10) | 0.03 | 2.70 | 455 | 11.4 | 0.01 |
| 110 (This Invention) | (13) | 0.02 | 2.68 | 451 | 11.3 | 0.03 |

It is clear from Table 1 that the samples in which couplers of this present invention had been used had high photographic speeds and high maximum color densities, a low absorbance ratio at 520 nm which is part of the yellow dye wavelength (gold - orange color) and excellent storage properties.

EXAMPLE 2

Samples 201 to 210 are prepared by replacing the tabular emulsion of samples 101 to 110 with a tetradecahedral emulsion (4 mol % silver iodide, average grain size 0.40 μm, variation coefficient of the grain size 0.12), and setting the coated silver weight to 1.10 g/m².

These samples are subjected to a white light exposure for sensitometric purposes and color developed and processed in the way indicated below.

The yellow densities of the processed samples are measured and the results are shown in Table 2.

Furthermore, the samples are stored for 7 days under conditions of 80° C., 50% relative humidity after measuring the densities and the loss in colored image density is obtained.

| Processing Operations | | |
|---|---|---|
| Process | Time | Temperature |
| First Development | 6 minutes | 38° C. |
| Water Wash | 2 minutes | 38° C. |
| Reversal | 2 minutes | 38° C. |
| Color Development | 6 minutes | 38° C. |
| Conditioning | 2 minutes | 38° C. |
| Bleaching | 6 minutes | 38° C. |
| Fixing | 4 minutes | 38° C. |
| Water Wash | 4 minutes | 38° C. |
| Stabilization | 1 minute | Normal Temperature |
| Drying | 4 minutes | 50° C. |

The composition of each processing bath was as indicated below.

| | |
|---|---|
| First Developer | |
| Water | 700 ml |
| Nitrilo-N,N,N-trimethyl-enephosphonic acid, penta-sodium salt | 2 grams |
| Sodium sulfite | 20 grams |
| Hydroquinone mono-sulfonate | 30 grams |
| Sodium carbonate (mono-hydrate) | 30 grams |
| 1-Phenyl-4-methyl-4-hydroxy-methyl-3-pyrazolidone | 2 grams |
| Potassium bromide | 2.5 grams |
| Potassium thiocyanate | 1.2 grams |
| Potassium iodide (0.1% solution) | 2 ml |
| Water to make up to | 1000 ml |
| Reversal Bath | |
| Water | 700 ml |
| Nitrilo-N,N,N-trimethyl-enephosphonic acid, penta-sodium salt | 3 grams |
| Stannous chloride (di-hydrate) | 1 gram |
| p-Aminophenol | 0.1 gram |
| Sodium hydroxide | 8 grams |
| Glacial acetic acid | 15 ml |
| Water to make up to | 1000 ml |
| Color Developer | |
| Water | 700 ml |
| Nitrilo-N,N,N-trimethyl-enephosphonic acid, penta-sodium salt | 3 grams |
| Sodium sulfite | 7 grams |
| Sodium triphosphate (dodeca-hydrate) | 36 grams |
| Potassium bromide | 1 gram |
| Potassium iodide (0.1% solution) | 90 ml |
| Sodium hydroxide | 3 grams |
| Citrazinic acid | 1.5 grams |
| N-Ethyl-N-(β-methanesulfonamido-ethyl)-3-methyl-4-aminoaniline sulfate | 11 grams |
| 3,6-Dithiaoctane-1,8-diol | 1 gram |

-continued

| | |
|---|---|
| Water to make up to | 1000 ml |
| Conditioner | |
| Water | 700 ml |
| Sodium sulfite | 12 grams |
| Ethylenediamine tetra-acetic acid, sodium salt, di-hydrate | 8 grams |
| Thioglycerine | 0.4 ml |
| Glacial acetic acid | 3 ml |
| Water to make up to | 1000 ml |
| Bleach | |
| Water | 800 ml |
| Ethylenediamine tetra-acetic acid, sodium salt, di-hydrate | 2 grams |
| Ethylenediamine tetra-acetic acid, iron(III) ammonium salt, di-hydrate | 120 grams |
| Potassium bromide | 100 grams |
| Water to make up to | 1000 ml |
| Fixer | |
| Water | 800 ml |
| Sodium thiosulfate | 80.0 grams |
| Sodium sulfite | 5.0 grams |
| Sodium bisulfite | 5.0 grams |
| Water to make up to | 1000 ml |
| Stabilizer | |
| Water | 800 ml |
| Formalin (37 wt %) | 5.0 ml |
| Fuji Driwell (a surfactant made by the Fuji Photographic Film Co.) | 5.0 ml |
| Water to make up to | 1000 ml |

TABLE 2

| Sample | Coupler | Maximum Color Density | Image Storage Properties (Fall in Density) |
|---|---|---|---|
| 201 (Comp. Ex.) | C-1 | 2.31 | 0.17 |
| 202 (Comp. Ex.) | C-2 | 1.96 | 0.04 |
| 203 (Comp. Ex.) | C-3 | 1.88 | 0.03 |
| 204 (Comp. Ex.) | C-4 | 1.85 | 0.03 |
| 205 (Comp. Ex.) | C-5 | 2.17 | 1.37 |
| 206 (Invention) | (1) | 2.51 | 0.02 |
| 207 (Invention) | (4) | 2.54 | 0.02 |
| 208 (Invention) | (9) | 2.56 | 0.02 |
| 209 (Invention) | (10) | 2.50 | 0.02 |
| 210 (Invention) | (13) | 2.48 | 0.03 |

It is clear from Table 2 that the samples of this present invention has a high color density and excellent colored image storage properties.

EXAMPLE 3

Samples 301 to 310 are prepared by replacing the tabular emulsion used in samples 101 to 110 with a cubic emulsion (silver chlorobromide, 1 mol % silver bromide, average grain size 0.25 μm, variation coefficient of the grain size 0.11) and providing a coated silver weight of 0.50 g/m², a coated weight of tricresyl phosphate of 0.30 g/m² and a coated weight of dibutyl phthalate of 1.0 g/m².

These samples are subjected to a white light exposure for sensitometric purposes and then processed using the color development processing operations indicated below, and the relative speeds and the maximum color densities were measured.

TABLE 3

| Sample | Coupler | Relative Speed | Maximum Color Density |
|---|---|---|---|
| 301 (Comp. Ex.) | C-1 | 0.00 | 2.43 |
| 302 (Comp. Ex.) | C-2 | −0.01 | 2.06 |
| 303 (Comp. Ex.) | C-3 | −0.02 | 2.04 |
| 304 (Comp. Ex.) | C-4 | −0.02 | 2.00 |

TABLE 3-continued

| Sample | Coupler | Relative Speed | Maximum Color Density |
|---|---|---|---|
| 305 (Comp. Ex.) | C-5 | 0.00 | 2.31 |
| 306 (Invention) | (1) | 0.02 | 2.67 |
| 307 (Invention) | (4) | 0.02 | 2.67 |
| 308 (Invention) | (9) | 0.01 | 2.66 |
| 309 (Invention) | (10) | 0.02 | 2.62 |
| 310 (Invention) | (13) | 0.01 | 2.60 |

It is clear from table 3 that the samples of this present invention had a high speed and a high color density.

| Process | Temperature | Time |
|---|---|---|
| Color Development | 38° C. | 35 seconds |
| Bleach-fix | 35° C. | 45 seconds |
| Rinse (1) | 35° C. | 30 seconds |
| Rinse (2) | 35° C. | 30 seconds |
| Rinse (3) | 35° C. | 30 seconds |
| Drying | 80° C. | 60 seconds |

The composition of each processing bath is indicated below.

| | |
|---|---|
| Color Developer | |
| Water | 800 ml |
| Ethylenediamine-N,N,N,N-tetramethylene phosphonic acid | 3.0 grams |
| Triethanolamine | 8.0 grams |
| Potassium chloride | 3.1 grams |
| Potassium bromide | 0.015 gram |
| Potassium carbonate | 25 grams |
| Hydrazino-di-acetic acid | 5.0 grams |
| N-Ethyl-N-(β-methanesulfonamido-ethyl)-3-methyl-4-aminoaniline sulfate | 5.0 grams |
| Fluorescent whitener (WHITEX-4, made by Sumitomo Chemicals) | 2.0 grams |
| Water to make up to | 1000 ml |
| pH (potassium hydroxide added) | 10.05 |
| Bleach-Fixer | |
| Water | 400 ml |
| Ammonium thiosulfate solution (700 g/l) | 100 ml |
| Ammonium sulfite | 45 grams |
| Ethylenediamine tetra-acetic acid, iron(III) ammonium salt | 55 grams |
| Ethylenediamine tetra-acetic acid | 3 grams |
| Ammonium bromide | 30 grams |
| Nitric acid (67%) | 27 grams |
| Water to make up to | 1000 ml |
| pH | 5.8 |

Rinse Bath

Ion exchanged water (Calcium and magnesium both less than 3 ppm)

EXAMPLE 4

Sample 401, a multi-layer color photosensitive material comprised of the layers of which the compositions are indicated below, was prepared on a cellulose triacetate film support on which an under-layer had been established.

Composition of the Photosensitive Layer

The numerical value corresponding to each component indicates the coated weight in units of g/m$^2$, the coated weight being shown as the calculated weight of silver in the case of the silver halides. However, with the sensitizing dyes the coated weight is indicated in units of mol per mol of silver halide in the same layer.

| Sample 401 | |
|---|---|
| First Layer (Anti-halation Layer) | |
| Black colloidal silver | as silver 0.18 |
| Gelatin | 1.40 |
| Second Layer (Intermediate Layer) | |
| 2,5-Di-tert-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third Layer (First Red Sensitive Emulsion Layer) | |
| Emulsion A | as silver 0.25 |
| Emulsion B | as silver 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.34 |
| Ex-8 | 0.035 |
| EX-10 | 0.020 |
| U-1 | 0.070 |
| U-2 | 0.050 |
| U-3 | 0.070 |
| HBS-1 | 0.060 |
| Gelatin | 0.87 |
| Fourth Layer (Second Red Sensitive Emulsion Layer) | |
| Emulsion G | as silver 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.40 |
| EX-3 | 0.050 |
| Ex-8 | 0.045 |
| EX-10 | 0.015 |
| U-1 | 0.070 |
| U-2 | 0.050 |
| U-3 | 0.070 |
| Gelatin | 1.30 |
| Fifth Layer (Third Red Sensitive Emulsion Layer) | |
| Emulsion D | as silver 1.60 |
| Sensitizing dye I | $5.4 \times 10^{-5}$ |
| Sensitizing dye II | $1.4 \times 10^{-5}$ |
| EX-3 | 0.010 |
| EX-4 | 0.080 |
| EX-8 | 0.015 |
| Coupler (C-6) | 0.020 |
| HBS-1 | 0.22 |
| HBS-2 | 0.10 |
| Gelatin | 1.63 |
| Sixth Layer (Intermediate Layer) | |
| EX-5 | 0.040 |
| HBS-1 | 0.020 |
| Gelatin | 0.50 |
| Seventh Layer (First Green Sensitive Emulsion Layer) | |
| Emulsion A | as silver 0.15 |
| Emulsion B | as silver 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.90 |
| EX-7 | 0.30 |
| EX-8 | 0.025 |
| EX-9 | 0.18 |
| Coupler (C-6) | 0.045 |
| HBS-1 | 0.10 |
| HBS-3 | 0.010 |
| Gelatin | 0.6 |
| Eighth Layer (Second Green Sensitive Emulsion Layer) | |
| Emulsion C | as silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |

-continued

| Sample 401 | |
|---|---|
| EX-6 | 0.035 |
| EX-7 | 0.026 |
| EX-9 | 0.060 |
| Coupler (C-6) | 0.020 |
| HBS-1 | 0.16 |
| HBS-3 | $8.0 \times 10^{-3}$ |
| Gelatin | 0.5 |
| Ninth Layer (Third Green Sensitive Emulsion Layer) | |
| Emulsion E | as silver 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.025 |
| EX-11 | 0.10 |
| EX-13 | 0.015 |
| HBS-1 | 0.25 |
| HBS-2 | 0.10 |
| Gelatin | 1.54 |
| Tenth Layer (Yellow Filter Layer) | |
| Yellow colloidal silver | as silver 0.050 |
| EX-5 | 0.080 |
| HBS-1 | 0.030 |
| Gelatin | 0.45 |
| Eleventh Layer (First Blue Sensitive Emulsion Layer) | |
| Emulsion A | as silver 0.080 |
| Emulsion B | as silver 0.070 |
| Emulsion F | as silver 0.070 |
| Sensitizing dye VII | $3.5 \times 10^{-4}$ |
| Coupler (C-6) | 0.075 |
| Coupler (C-1) | 0.72 |
| HBS 1 | 0.28 |
| Gelatin | 1.10 |
| Twelfth Layer (Second Blue sensitive Emulsion Layer) | |
| Emulsion G | as silver 0.45 |
| Sensitizing dye VII | $2.1 \times 10^{-4}$ |

-continued

| Sample 401 | |
|---|---|
| Coupler (C-1) | 0.15 |
| EX-10 | $7.0 \times 10^{-3}$ |
| HBS-1 | 0.050 |
| Gelatin | 0.78 |
| Thirteenth Layer (Third Blue sensitive Emulsion Layer) | |
| Emulsion H | as silver 0.77 |
| Sensitizing dye VII | $2.2 \times 10^{-4}$ |
| Coupler (C-1) | 0.20 |
| HBS-1 | 0.070 |
| Gelatin | 0.69 |
| Fourteenth Layer (First Protective Layer) | |
| Emulsion I | as silver 0.20 |
| U-4 | 0.11 |
| U-5 | 0.17 |
| HBS-1 | $5.0 \times 10^{-2}$ |
| Gelatin | 0.45 |
| Fifteenth Layer (Second Protective Layer) | |
| H-1 | 0.40 |
| B-1 (Diameter 1.7 μm) | $5.0 \times 10^{-2}$ |
| B-2 (Diameter 1.7 μm) | 0.10 |
| B-3 | 0.10 |
| S-1 | 0.20 |
| Gelatin | 0.40 |

Furthermore, W-1, W-2, W-3, B-4, B-5, F-1, F-2, F-3, F-4, F-5, F-6, F-7, F-8, F-9, F-10, F-11, F-12 and F-13, and iron salts, lead salts, gold salts, platinum salts, iridium salts and rhodium salts were included in all of the layers with a view to improving storage properties, processing properties, pressure resisting properties, fungicidal and biocidal properties, anti-static properties and coating properties.

Compositions of the emulsions and chemical structures of the compounds used are shown below.

TABLE 4

| Emulsion | Average AgI Content (%) | Average Grain Size (μm) | Variation Coefficient of the Grain Size (%) | Diameter/ Thickness Ratio | Silver Weight Ratio (AgI Content %) |
|---|---|---|---|---|---|
| A | 4.0 | 0.45 | 27 | 1 | Core/Shell = ⅓ (13/1), double structure grains |
| B | 8.9 | 0.55 | 14 | 1 | Core/Shell = 3/7 (25/2), double structure grains |
| C | 10 | 0.60 | 30 | 2 | Core/Shell = ⅓ (24/3), double structure grains |
| D | 16 | 0.85 | 15 | 6 | Core/Shell = 4/6 (40/02), double structure grains |
| E | 10 | 0.85 | 20 | 7 | Core/Shell = ⅓ (24/3), double structure grains |
| F | 4.0 | 0.25 | 15 | 1 | Core/Shell = ⅓ (13/1), double structure grains |
| G | 14.0 | 0.65 | 19 | 5 | Core/Shell = ⅓ (42/0), double structure grains |
| H | 14.5 | 1.10 | 18 | 7 | Core/Shell = 37/63 (34/2), double structure grains |
| I | 1 | 0.07 | 15 | 1 | Uniform grains |

EX-1

-continued
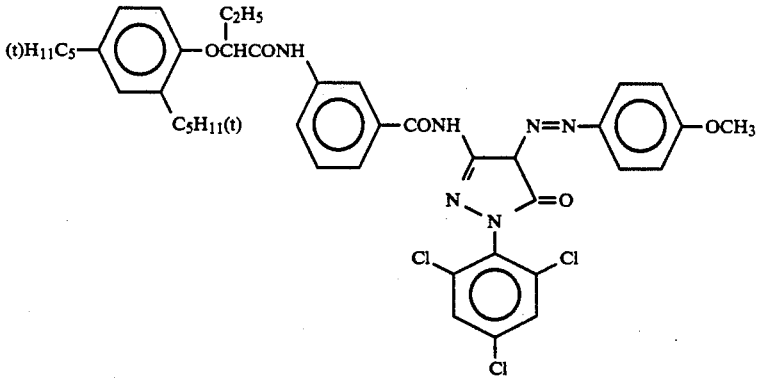
EX-2
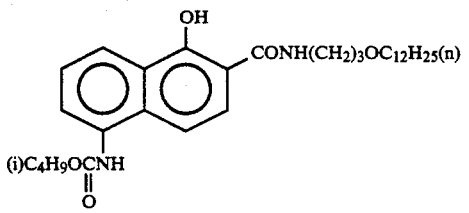
EX-3
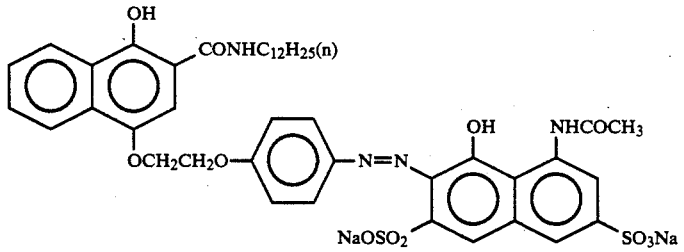
EX-4
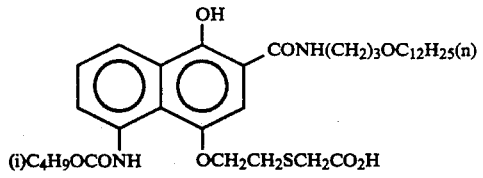
EX-5
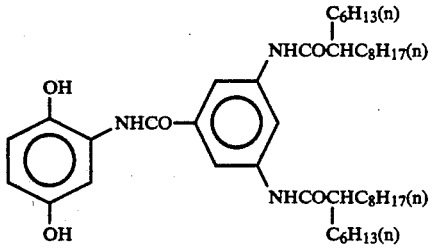
EX-6

-continued
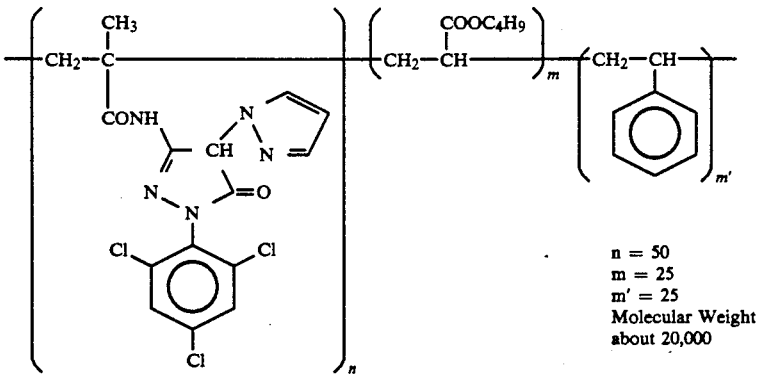
EX-7
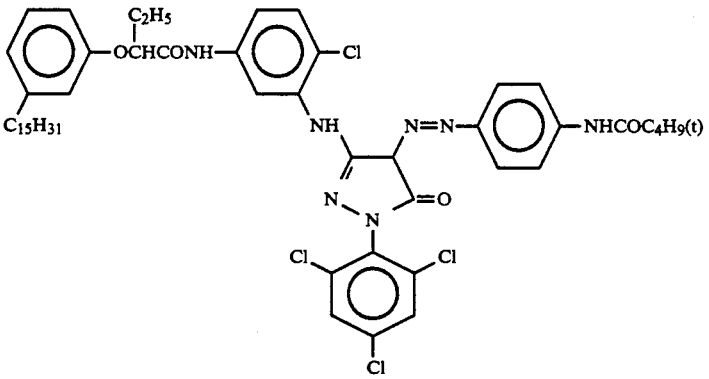
EX-8
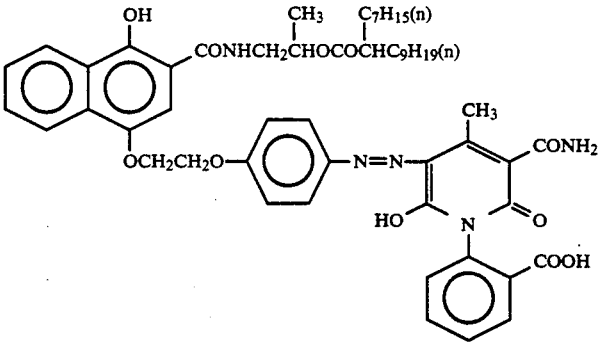
EX-9
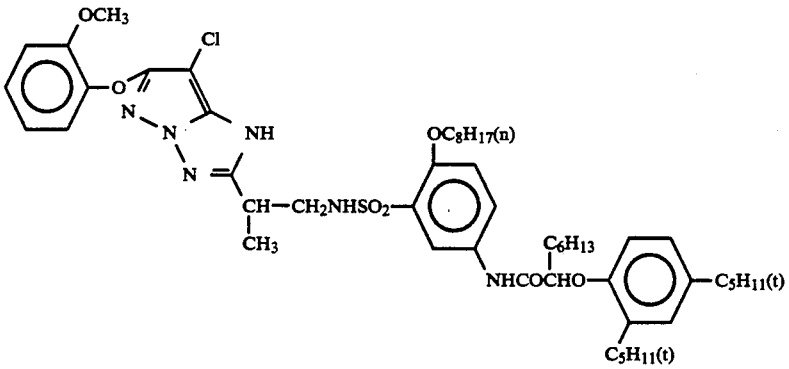
EX-10

-continued
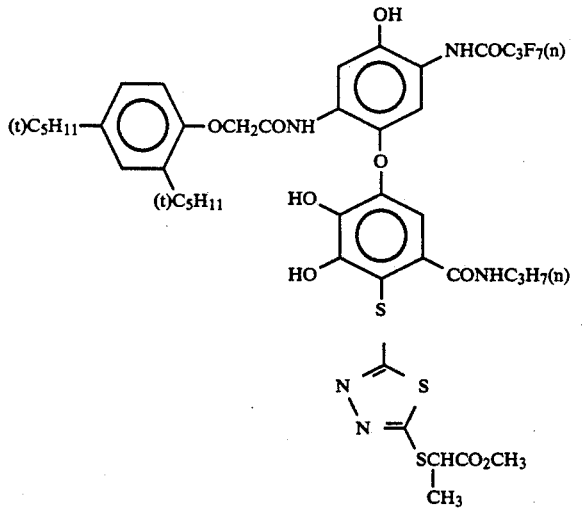
EX-11
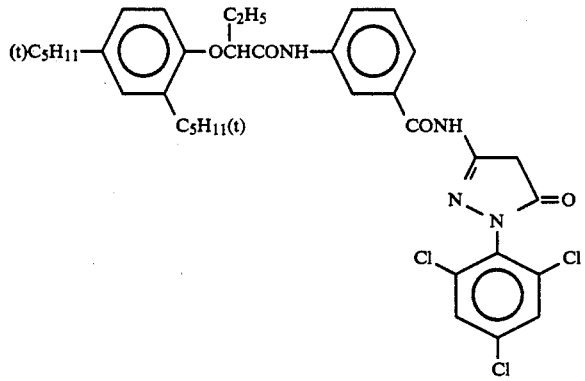
EX-12
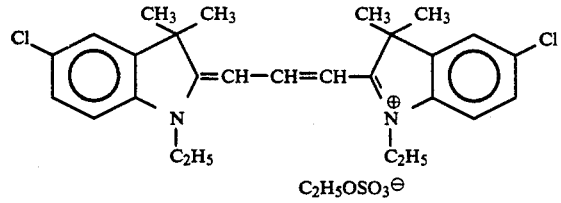
EX-13
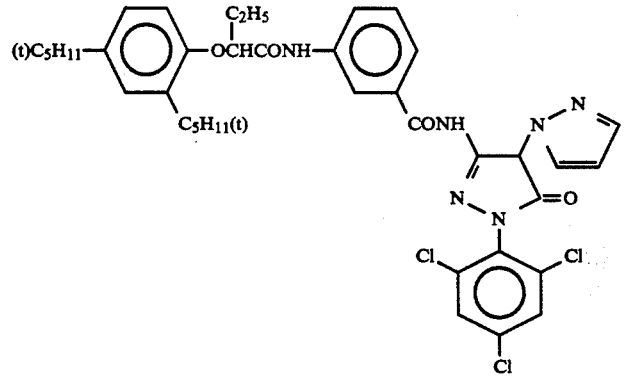
U-1

-continued
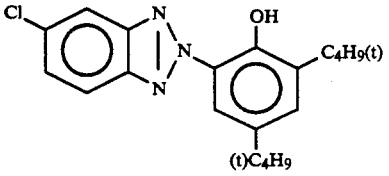
U-2
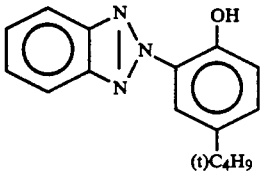
U-3
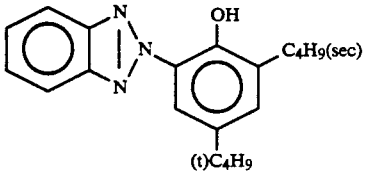
U-4
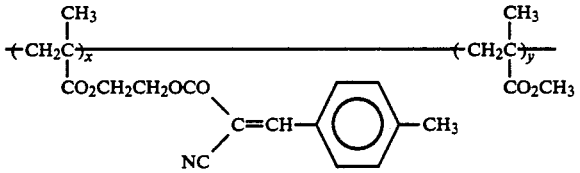
x:y = 70:30 (wt %)
U-5
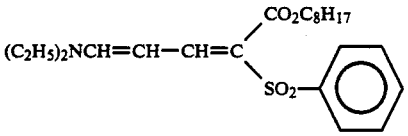
HBS-1
Tricresyl phosphate
HBS-2
Di-n-butyl phthalate
HBS-3
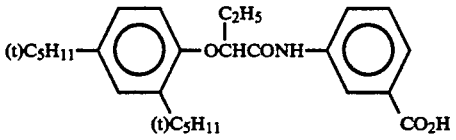
Sensitizing Dye I
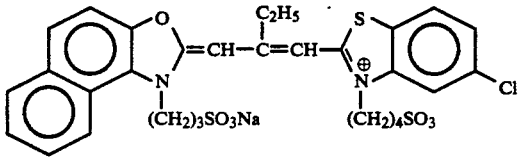
Sensitizing Dye II -continued
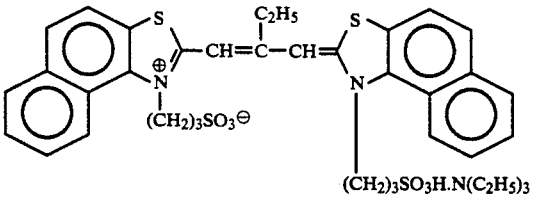
Sensitizing Dye III
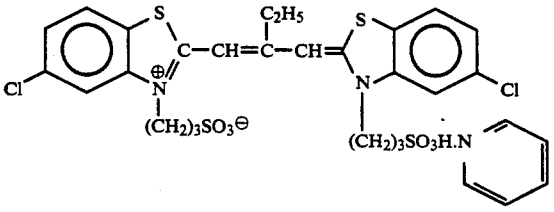
Sensitizing Dye IV
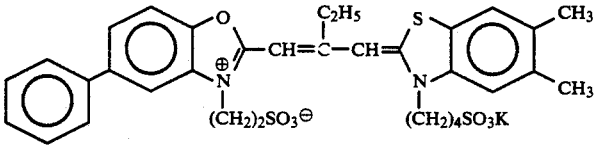
Sensitizing Dye V
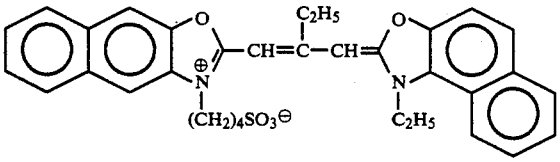
Sensitizing Dye VI
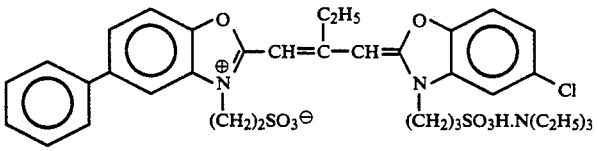
Sensitizing Dye VII
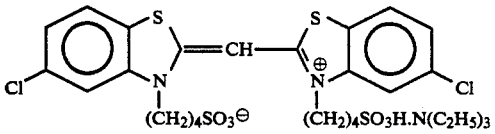
S-1
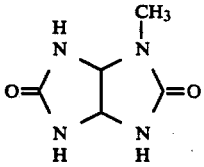
H-1
$CH_2{=}CH{-}SO_2{-}CH_2{-}CONH{-}CH_2$
$CH_2{=}CH{-}SO_2{-}CH_2{-}CONH{-}CH_2$
B-1
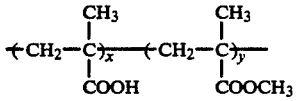
x/y = 10/90

-continued
B-2
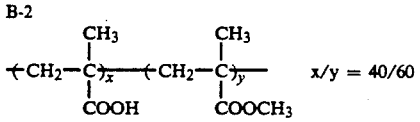
x/y = 40/60
B-3
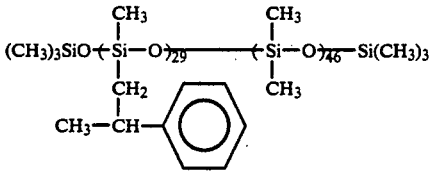
B-4
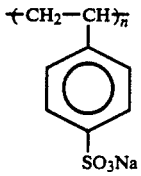
B-5
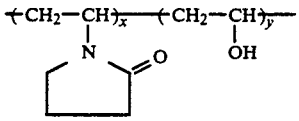
x/y = 70/30
W-1
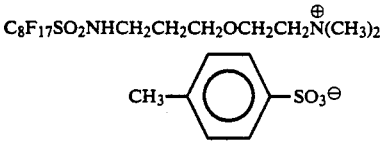
W-2
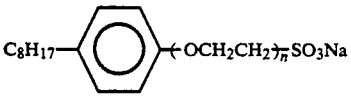
n = 2~4
W-3
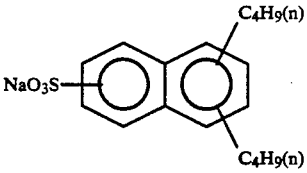
F-1
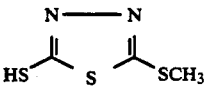
F-2
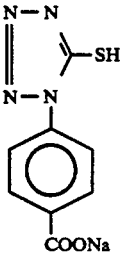
F-3

-continued
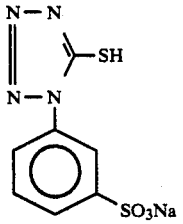
F-4
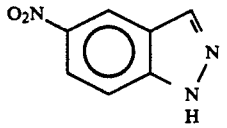
F-5
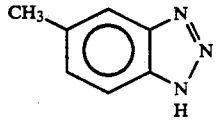
F-6
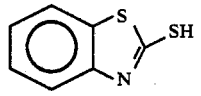
F-7
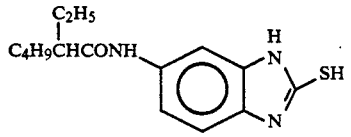
F-8
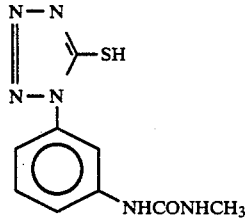
F-9
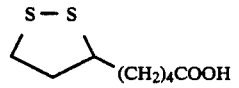
F-10
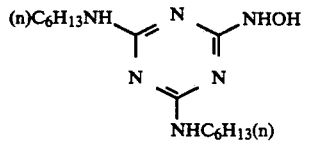
F-11
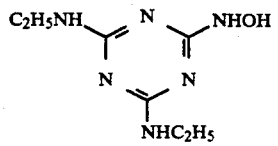
F-12

-continued

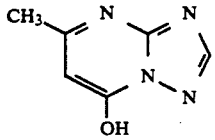

F-13

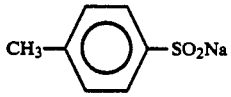

SAMPLES 402–413

Samples 402 to 413 are prepared by replacing the coupler (C-6) in the fifth, seventh, eighth and eleventh layers of sample 401 with a comparative coupler or a coupler of this present invention in the mol ratio indicated in Table 4. The amount of coupler added is determined in such a way that the speed and gamma values after white imagewise exposure and color development processing in the way indicated below are more or less the same.

These samples are subjected to a green imagewise exposure and then color developed using the processing operations indicated below. The value obtained by subtracting the yellow fog density from the yellow density at a magenta density of (fog+1.0) is taken as the extent of color mixing and this is shown in Table 4.

The samples are also subjected to a white light imagewise exposure and, after being processed, they were stored for 7 days at 80° C., 60% relative humidity or irradiated for 7 days from the emulsion side with fluorescent light of intensity 20,000 lux, and then the decreased densities at an initial yellow density of 2.5 are measured.

| | Processing Operations | | | |
|---|---|---|---|---|
| Process | Processing Time | Processing Temp. | Replenishment Rate | Tank Capacity |
| Color development | 3 min. 15 sec. | 37.8° C. | 25 ml | 10 liters |
| Bleach | 45 seconds | 38.0° C. | 5 ml | 5 liters |
| Fix (1) | 45 seconds | 38.0° C. | — | 5 liters |
| Fix (2) | 45 seconds | 38.0° C. | 30 ml | 5 liters |
| Stabilizer (1) | 30 seconds | 38.0° C. | — | 5 liters |
| Stabilizer (2) | 20 seconds | 38.0° C. | — | 5 liters |
| Stabilizer (3) | 20 seconds | 38.0° C. | 40 ml | 5 liters |
| Drying | 1 minute | 55° C. | | |

Replenishment rate per square meter of width 35 mm
A counter-flow system from fix (2) to fix (1)
A counter-flow system from stabilized (3) to stabilizer (1)

Moreover, the carry-over of developer into the bleach process and the carry-over of fixer into the stabilizing process are 2.5 ml and 2.0 ml respectively per meter length of photosensitive material of width 35 mm.

The compositions of the processing baths are as indicated below.

| | Parent Bath (grams) | Replenisher (grams) |
|---|---|---|
| Color Development Bath | | |
| Diethylenetriamine penta-acetic acid | 5.0 | 6.0 |
| Sodium sulfite | 4.0 | 5.0 |
| Potassium carbonate | 30.0 | 37.0 |

-continued

| | | |
|---|---|---|
| Potassium bromide | 1.3 | 0.5 |
| Potassium iodide | 1.2 mg | — |
| Hydroxylamine sulfate | 2.0 | 3.6 |
| 2-[N-Ethyl-N-β-hydroxyethyl-amino]-2-methylaniline sulfate | 4.7 | 6.2 |
| Water to make up to | 1.0 liter | 1.0 liter |
| pH | 10.00 | 10.15 |
| Bleach | | |
| 1,3-Diaminopropane tetra-acetic acid, ferric ammonium salt, mono-hydrate | 144.0 | 206.0 |
| 1,3-Diaminopropane tetra-acetic acid | 2.8 | 4.0 |
| Potassium bromide | 84.3 | 120.0 |
| Ammonium nitrate | 17.5 | 25.0 |
| Aqueous ammonia (27%) | 10.0 | 1.8 |
| Acetic acid (98%) | 51.1 | 73.0 |
| Water to make up to | 1.0 liter | 1.0 liter |
| pH | 4.3 | 3.4 |

| | (Grams) |
|---|---|
| Fixer Parent Bath (Replenisher has the same composition) | |
| Ethylenediamine tetra-acetic acid, disodium salt | 1.7 |
| Sodium sulfite | 14.0 |
| Sodium bisulfite | 10.0 |
| Aqueous ammonium thiosulfate solution, (70% wt/vol) | 210.0 ml |
| Ammonium thiocyanate | 163.0 |
| Thiourea | 1.8 |
| Water to make up to | 1.0 liter |
| pH | 6.5 |
| Stabilizer Parent bath (Replenisher has the same composition) | |
| Surfactant | 0.5 |

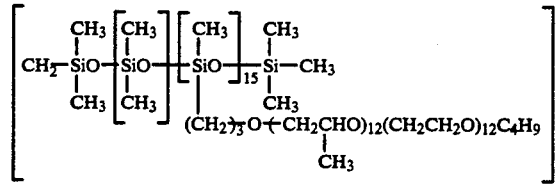

| | |
|---|---|
| Surfactant | 0.4 |
| $[C_{10}H_{21}-O-(CH_2CH_2O)_{10}-H]$ | |
| Triethanolamine | 2.0 |
| 1,2-Benzisothiazolin-3-one methanol | 0.3 |
| Formalin (37%) | 1.5 |
| Water to make up to | 1.0 liter |
| pH | 6.5 |

TABLE 5

| Sample | Coupler in the 4,7,8, and 11 Layers Type | Amount | Extent of Color Mixing | Fall in Density in Forced Heating Test | Fall in Density in Forced Light Test |
|---|---|---|---|---|---|
| 401 (Comparative Example) | C-6 | 1.0 | 0.07 | 0.22 | 0.19 |
| 402 (Comparative Example) | C-7 | 3.0 | 0.16 | 0.12 | 0.13 |
| 403 (Comparative Example) | C-8 | 1.2 | 0.18 | 0.18 | 0.14 |
| 404 (Comparative Example) | C-9 | 1.0 | 0.13 | 0.13 | 0.10 |
| 405 (Comparative Example) | C-10 | 1.0 | 0.09 | 0.17 | 0.14 |
| 406 (Comparative Example) | C-11 | 0.9 | 0.07 | 0.26 | 0.22 |
| 407 (This Invention) | (2) | 2.0 | 0.07 | 0.06 | 0.03 |
| 408 (This Invention) | (3) | 1.5 | 0.06 | 0.06 | 0.02 |
| 409 (This Invention) | (8) | 1.2 | 0.06 | 0.07 | 0.03 |
| 410 (This Invention) | (14) | 1.2 | 0.06 | 0.06 | 0.02 |
| 411 (This Invention) | (25) | 1.0 | 0.06 | 0.06 | 0.02 |
| 412 (This Invention) | (39) | 0.8 | 0.06 | 0.09 | 0.03 |
| 413 (This Invention) | (61) | 2.0 | 0.07 | 0.10 | 0.03 |

It is clear from Table 4 that the samples in which a coupler of this present invention had been used had excellent color reproduction as show by the extent of color mixing, and excellent colored image storage properties.

EXAMPLE 5

The C-5 (comparative coupler (C-2) of this present invention) in the twelfth layer and the C-7 in the thirteenth layer in JP-A-2-854 are replaced by equimolar amounts of couplers (1), (4), (9) and (11) of this present invention and, on processing in the way described in Example 2 after subjecting the samples to a blue image-wise exposure, good yellow dye images which has a good yellow density and little admixture of orange are obtained.

EXAMPLE 6

Sample No. 214 (a multi-layer color paper) disclosed in example 2 of European Patent EP-0,355,660A2 is used as a silver halide color photosensitive material. However, III-10 is used instead of the III-23 disclosed in the said patent as a bisphenol compound and the compounds indicated below are used for the yellow coupler (ExY), the cyan coupler (ExC), the image stabilizer (Cpd-8), the solvent (Solv-6) and the oxonol dye. Moreover, the compounds indicated below are used as fungicides (biocides) in the preparation of sample 601.

(ExY) Yellow Coupler:
A 1:1 (mol ratio) mixture of:

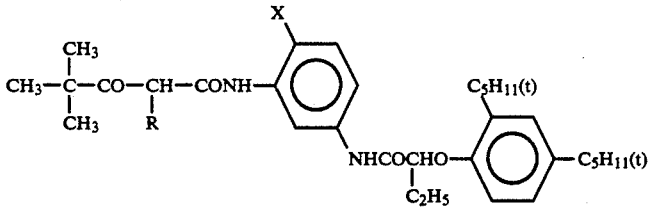

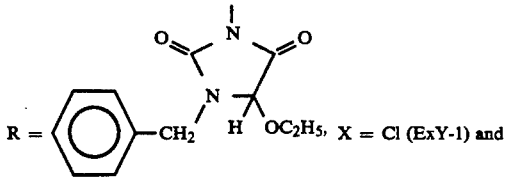

R =  X = Cl (ExY-1) and

R = 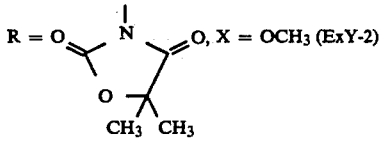 O, X = $OCH_3$ (ExY-2)

(ExC) Cyan Coupler:
A 1:1:1 (mol ratio) mixture of:

-continued
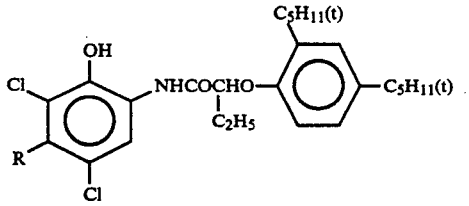
R = $CH_3$ and R = $C_2H_5$ and
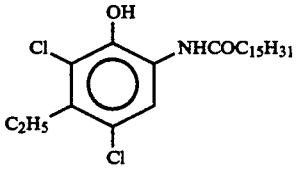
(Cpd-8) Colored Image Stabilizer:
A 1:1 (mol ratio) mixture of:
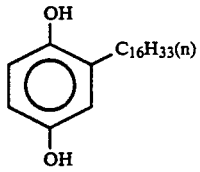
and
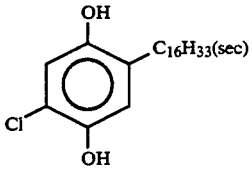
(Cpd-10) Fungicide
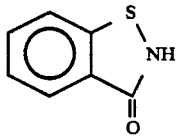
(25.0 mg/$m^2$)
(Cpd-11) Fungicide
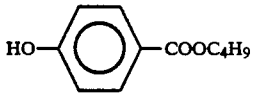
(50.0 mg/$m^2$)
(Solv-6) Solvent
A 9:1 (by weight) mixture of:
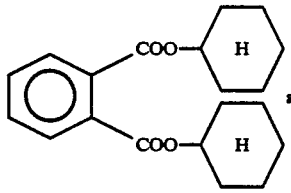
and $C_8H_{17}CHCH(CH_2)_7COOC_8H_{17}$
(Oxonol Dyes)
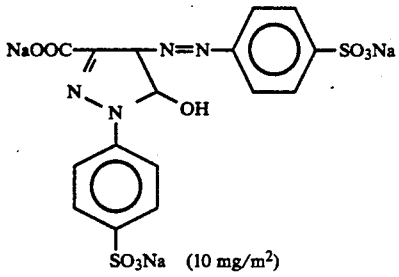
(10 mg/$m^2$)

-continued

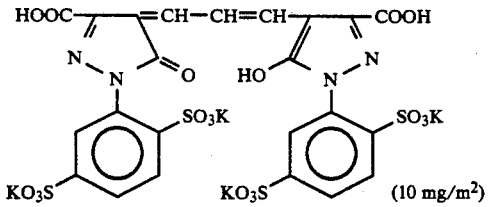

(10 mg/m²)

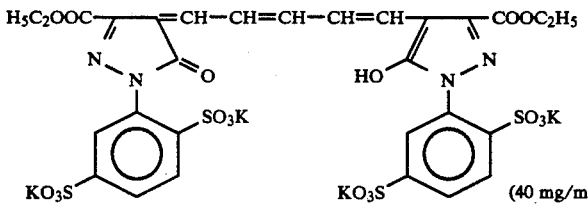

(40 mg/m²) and

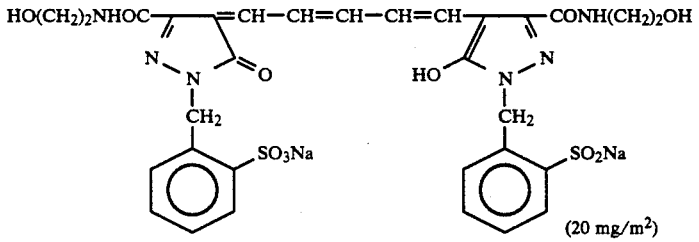

(20 mg/m²)

Samples 602 to 604 are prepared by replacing the ExY-1 in sample 106 with equimolar amounts of the couplers (4), (10) and (13) of this present invention. Furthermore, samples 605 to 608 are prepared by replacing the ExY-2 with couplers (1), (5), (7) and (9) of this present invention. These samples are subjected to a blue imagewise exposure and, on color development and processing using the method disclosed in example 2 of the aforementioned patent, samples 602 to 608 in which couplers of this present invention had been used provided lemon yellow colored images which had a high yellow density and less long wave absorbance than sample 601.

Comparative couplers used in the Examples are listed below.

(Compound 1, Research Disclosure No. 18053) C-1

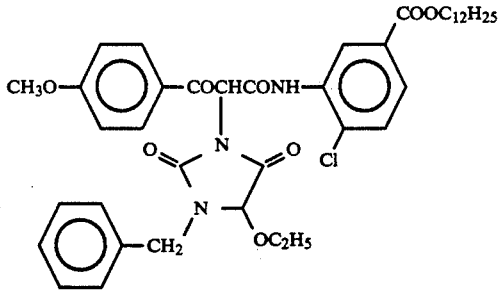

(Compound 14 of Research Disclosure No. 18053) C-2

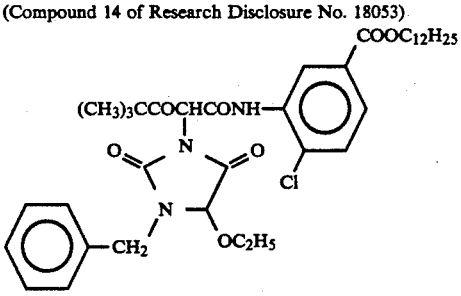

(Coupler (65) of U.S. Pat. No. 4,440,274) C-3

-continued
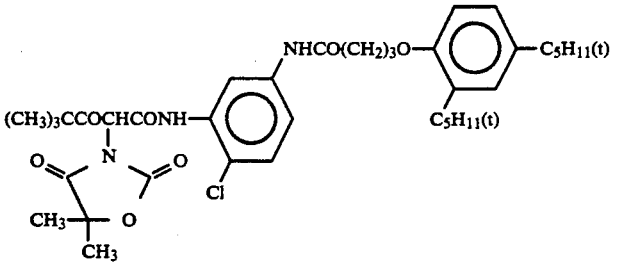
(Coupler A of U.S. Pat. No. 3,933,501) C-4
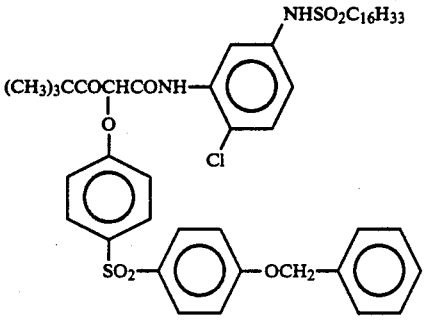
(Coupler Similar to Coupler Disclosed in U.S. Pat. No. 4,149,886) C-5
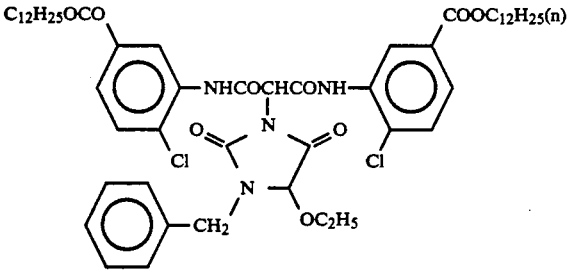
(Coupler (16) disclosed in U.S. Pat. No. 4,477,563) C-6
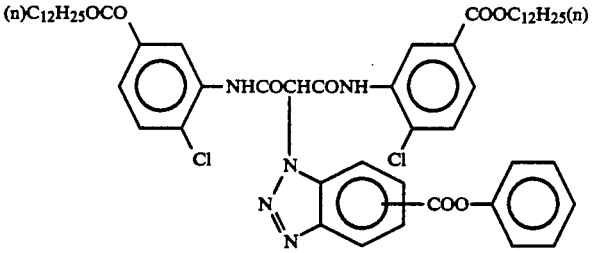
(Coupler similar to the couplers disclosed in U.S. Pat. No. 4,149,886 and British Patent 1,204,6809 C-7
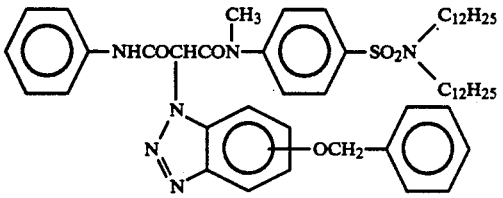
Coupler Similar to Coupler (40) of U.S. Pat. No. 3,632,345) C-8

-continued

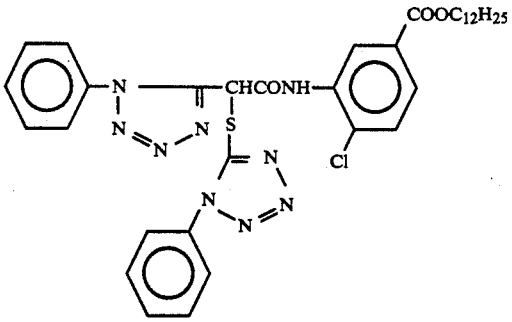

(Coupler of JP-A-63-261262) C-9

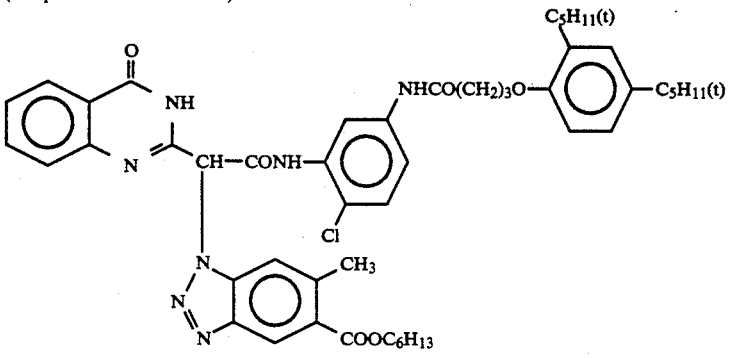

(Coupler of JP-A-H2-28645) C-10

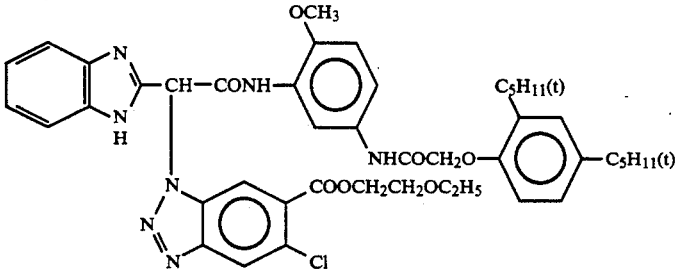

(Coupler of JP-A-H2-2552) C-11

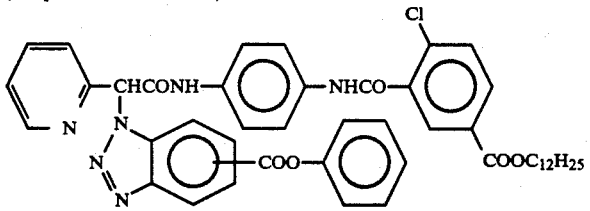

EFFECT OF THE INVENTION

The yellow couplers of this present invention form images which have excellent color reproduction and image fastness. In terms of color reproduction they are effective in that in the spectral absorbance of the dyes the tail on the long wave length side in particular is short. In terms of image fastness, the images can be stored for long periods in respect to both heat and humidity, and light. Furthermore, the dyes obtained from the yellow couplers of this present invention have large molecular extinction coefficients and, since the reactivity of the couplers with the oxidized form of a developing agent is also high, they provide high maximum color densities as a characteristic feature. Consequently, it is possible to reduce the amount of coupler required to provide a given density and so the film thickness of the emulsion layer can be reduced.

The distinguishing feature of the couplers of this present invention is that one malondiamide is a cyclic amino group. It is thought that it is because of this that the good spectral absorption of the dye and the improved image fastness are achieved.

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material comprising a photographic coupler represented by general formula (I):

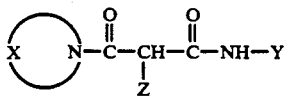

(I)

wherein X represents an organic residual group, which together with the nitrogen atom, forms a nitrogen containing heterocyclic ring comprising at least one ethylenically unsaturated group or at least two hetero atoms as ring constituent atoms, Y represents an aromatic group or a heterocyclic group, an Z represents a group which is eliminated when the photographic coupler reacts with an oxidized form of a developing agent.

2. The silver halide color photographic material as claimed in claim 1, wherein said nitrogen-containing heterocyclic group formed of X< and >N— of general formula (I) is a 5- or 6-membered nitrogen-containing heterocyclic group.

3. The silver halide color photographic photosensitive material as claimed in claim 1, wherein the photographic coupler is a nondiffusive coupler and Y of general formula (I) is a phenyl group having at least one substituent group in the ortho-position.

4. The silver halide color photographic photosensitive material as claimed in claim 1, wherein the heterocyclic group formed by X< and >N— is selected from the group consisting of indolinyl, 2,3,4,5-tetrahydroquinolyl, isoindolino, and 4-oxopiperidino.

5. The silver halide color photographic photosensitive material as claimed in claim 1, wherein the heterocyclic group formed by X< and >N— is selected from the group consisting of morpholino, piperadino, perhydro-1,1-dioxo-1,4-thiazine-4-yl, and benzomorpholino.

6. The silver halide color photographic photosensitive material as claimed in claim 1, wherein Y is an aromatic group having 6 to 10 carbon atoms.

7. The silver halide color photographic photosensitive material as claimed in claim 1, wherein Y is a heterocyclic group which has at least 1 to 10 carbon atoms.

8. The silver halide color photographic photosensitive material as claimed in claim 1, wherein said photographic coupler is present in an amount from 0.001 to 0.80 g/m$^2$.

9. The silver halide color photographic photosensitive material as claimed in claim 1, wherein said photographic coupler is present in an amount from 0.001 to 1.20 g/m$^2$.

10. A silver halide color photographic photosensitive material comprising a photographic coupler represented by the general formula (II):

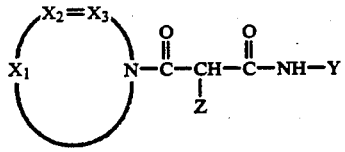

(II)

wherein $X_1$ represents an organic residual group, which together with —$X_2$=$X_3$—N<, forms a nitrogen containing heterocyclic ring, and $X_2$ and $X_3$ each represents a methine group or a nitrogen atom, Y represents an aromatic group or a heterocyclic group, and Z represents a group which is eliminated when the photographic coupler reacts with an oxidized form of a developing agent.

11. The silver halide color photographic photosensitive material as claimed in claim 10, wherein the photographic coupler is a nondiffusive coupler and Y of general formula (II) is a phenyl group having at least one substituent group, in the ortho-position.

12. A silver halide color photographic photosensitive material comprising a photographic coupler represented by general formula (III):

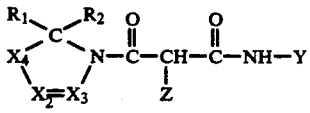

(III)

wherein $X_2$ and $X_3$ each represents a methine group or a nitrogen atom, and $X_4$ represents a divalent organic group $R_1$ and $R_2$ each represents a hydrogen atom or another substituent, y represents an aromatic group or a heterocyclic group, and Z represents a group which is eliminated when the photographic coupler reacts with an oxidized form of a developing agent.

13. The silver halide color photographic photosensitive material as claimed in claim 12, wherein the photographic coupler is a nondiffusive coupler and Y of general formula (III) is a phenyl group having at least one substituent group, in the ortho-position.

* * * * *